US012428700B2

(12) United States Patent
Tobata et al.

(10) Patent No.: US 12,428,700 B2
(45) Date of Patent: Sep. 30, 2025

(54) HIGH STRENGTH STEEL SHEET AND METHOD FOR MANUFACTURING THE SAME

(71) Applicant: JFE Steel Corporation, Tokyo (JP)

(72) Inventors: Junya Tobata, Tokyo (JP); Yuki Toji, Tokyo (JP)

(73) Assignee: JFE-STEEL CORPORATION, Tokyo (JP)

( * ) Notice: Subject to any disclaimer, the term of this patent is extended or adjusted under 35 U.S.C. 154(b) by 77 days.

(21) Appl. No.: 18/564,791

(22) PCT Filed: May 19, 2022

(86) PCT No.: PCT/JP2022/020893

§ 371 (c)(1),
(2) Date: Nov. 28, 2023

(87) PCT Pub. No.: WO2022/259838

PCT Pub. Date: Dec. 15, 2022

(65) Prior Publication Data

US 2024/0376562 A1 Nov. 14, 2024

(30) Foreign Application Priority Data

Jun. 11, 2021 (JP) ..... 2021-098035

(51) Int. Cl.

| | |
|---|---|
| ***C21D 9/46*** | (2006.01) |
| ***C21D 1/18*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |

(Continued)

(52) U.S. Cl.

CPC ..... *C21D 9/46* (2013.01); *C21D 1/18* (2013.01); *C21D 6/001* (2013.01); *C21D 6/002* (2013.01); *C21D 6/005* (2013.01); *C21D 6/007* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 8/0278* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/38* (2013.01); *C22C 38/60* (2013.01); *C21D 2211/001* (2013.01); *C21D 2211/005* (2013.01); *C21D 2211/008* (2013.01)

(58) Field of Classification Search

CPC . C21D 9/46; C21D 1/18; C21D 6/001; C21D 6/002; C21D 6/005; C21D 6/007; C21D 6/008; C21D 8/0205; C21D 8/0236; C21D 8/0278; C21D 2211/001; C21D 2211/005; C21D 2211/008; C22C 38/02; C22C 38/04; C22C 38/06; C22C 38/001; C22C 38/002; C22C 38/005; C22C 38/008; C22C 38/08; C22C 38/10; C22C 38/12; C22C 38/14; C22C 38/16; C22C 38/38; C22C 38/60

USPC ..... 428/639

See application file for complete search history.

(56) References Cited

U.S. PATENT DOCUMENTS

| | | | |
|---|---|---|---|
| 2016/0032432 | A1 | 2/2016 | Li et al. |
| 2018/0100212 | A1 | 4/2018 | Ono et al. |
| 2019/0017156 | A1 | 1/2019 | Kawamura et al. |

(Continued)

FOREIGN PATENT DOCUMENTS

| | | | |
|---|---|---|---|
| EP | 3 950 975 | A1 | 2/2022 |
| JP | 2016509631 | A | 3/2016 |

(Continued)

OTHER PUBLICATIONS

Misaka et al., "Correction of Flatness of Cold-Rolled Steel Sheet by Tension Leveler", Journal of Japan Society for Technology of Plasticity, Dec. 1976, vol. 17, No. 191, pp. 988-994, with English Translation. (22 pages).

(Continued)

*Primary Examiner* — Katherine A Christy

(74) *Attorney, Agent, or Firm* — Buchanan Ingersoll & Rooney PC

(57) ABSTRACT

A high strength steel sheet includes a specific microstructure having a specific chemical composition and satisfying the formulas (1) and (2) defined below:

$$KAM\,(S)/KAM\,(C) < 1.00 \quad (1)$$

wherein KAM (S) is a KAM (Kernel average misorientation) value of a superficial portion of the steel sheet, and KAM (C) is a KAM value of a central portion of the steel sheet, $$Hv\,(Q) - Hv\,(S) \geq 8 \quad (2)$$

(Continued)

wherein Hv (Q) indicates the hardness of a portion at ¼ sheet thickness and Hv (S) indicates the hardness of a superficial portion of the steel sheet.

12 Claims, No Drawings

(51) Int. Cl.
*C22C 38/38* (2006.01)
*C22C 38/60* (2006.01)

(56) References Cited

U.S. PATENT DOCUMENTS

| | | | |
|---|---|---|---|
| 2020/0040420 | A1 | 2/2020 | Minami et al. |
| 2020/0377978 | A1 | 12/2020 | Yoshitomi et al. |
| 2021/0155999 | A1 | 5/2021 | Yokoyama et al. |
| 2022/0063245 | A1 | 3/2022 | Nakano et al. |
| 2022/0195556 | A1 | 6/2022 | Nakano et al. |
| 2022/0267874 | A1 | 8/2022 | Nakano et al. |

FOREIGN PATENT DOCUMENTS

| | | | |
|---|---|---|---|
| JP | 6112261 | B2 | 4/2017 |
| JP | 6354909 | B2 | 7/2018 |
| JP | 6525114 | B1 | 6/2019 |
| WO | 2018147400 | A1 | 8/2018 |
| WO | 2019212045 | A1 | 11/2019 |
| WO | 2020/203158 | A1 | 10/2020 |
| WO | 2020196060 | A1 | 10/2020 |
| WO | 2020262651 | A1 | 12/2020 |
| WO | 2020262652 | A1 | 12/2020 |

OTHER PUBLICATIONS

Extended European Search Report issued Sep. 13, 2024, by the European Patent Office in corresponding European Patent Application No. 22820020.0-1103. (8 pages).

International Search Report and Written Opinion for International Application No. PCT/JP2022/020893, dated Aug. 9, 2022, 6 pages.

HIGH STRENGTH STEEL SHEET AND METHOD FOR MANUFACTURING THE SAME

CROSS REFERENCE TO RELATED APPLICATIONS

This is the U.S. National Phase application of PCT/JP2022/020893, filed May 19, 2022, which claims priority to Japanese Patent Application No. 2021-098035, filed Jun. 11, 2021, the disclosures of these applications being incorporated herein by reference in their entireties for all purposes.

FIELD OF THE INVENTION

The present invention relates to a high strength steel sheet excellent in tensile strength, elongation, and delayed fracture resistance, and to a method for manufacturing the same. The high strength steel sheet according to aspects of the present invention may be suitably used as structural members, such as automobile parts.

BACKGROUND OF THE INVENTION

Steel sheets for automobiles are being increased in strength to reduce $CO_2$ emissions by weight reduction of vehicles and to enhance crashworthiness by weight reduction of automobile bodies at the same time, with introduction of new laws and regulations one after another. To increase the strength of automobile bodies, high strength steel sheets having a tensile strength (TS) of 1320 MPa or higher class are increasingly applied to principal structural parts of automobiles. High strength steel sheets used for automobiles are required to have excellent formability. Excellent elongation (El) is also required because press forming becomes difficult with increasing strength of steel sheets.

Automobile frame parts have many end faces formed by shearing. The morphology of a sheared end face depends on the shear clearance. In the process of forming a part, a sheared end face is subjected to hole expansion. Cracking should not occur during this deformation. Cracking that is caused by hole expanding deformation after shearing depends on the morphology of the sheared end face, that is, the shear clearance. A wide range of appropriate clearances that do not lead to cracking is desired. Furthermore, the shear clearance also affects delayed fracture resistance. Here, delayed fracture is a phenomenon in which, when a formed part is placed in a hydrogen penetration environment, hydrogen penetrates into the steel sheet constituting the part to cause a decrease in interatomic bonding force or to cause local deformation, thus giving rise to microcracks that grow to fracture. High strength steel sheets used for automobiles are also required to have a wide range of appropriate clearances not leading to delayed fracture.

To cope with these demands, for example, Patent Literature 1 provides a high strength steel sheet having a tensile strength of 980 MPa or more and excellent bending formability, and a method for manufacturing the same. However, the technique described in Patent Literature 1 does not consider the range of appropriate clearances for hole expanding deformation or the range of appropriate clearances not leading to delayed fracture.

For example, Patent Literature 2 provides a high strength steel sheet having a tensile strength of 1320 MPa or more and excellent delayed fracture resistance at sheared end faces, and a method for manufacturing the same. However, the technique described in Patent Literature 2 does not consider the range of appropriate clearances for hole expanding deformation or the range of appropriate clearances not leading to delayed fracture.

For example, Patent Literature 3 provides a high strength steel sheet having a tensile strength of 1100 MPa or more and being excellent in YR, surface quality, and weldability, and a method for manufacturing the same. However, the technique described in Patent Literature 3 does not consider the range of appropriate clearances for hole expanding deformation or the range of appropriate clearances not leading to delayed fracture.

PATENT LITERATURE

PTL 1: Japanese Patent No. 6354909
PTL 2: Japanese Patent No. 6112261
PTL 3: Japanese Patent No. 6525114

SUMMARY OF THE INVENTION

Aspects of the present invention have been developed in view of the circumstances discussed above. Objects according to aspects of the present invention are therefore to provide a high strength steel sheet having a TS of 1320 MPa or more and El≥8% and having a wide range of appropriate clearances for hole expanding deformation and a wide range of appropriate clearances not leading to delayed fracture; and to provide a method for manufacturing the same.

The present inventors carried out extensive studies directed to solving the problems described above and have consequently found the following facts.

(1) 1320 MPa or higher TS can be achieved by limiting the total of ferrite and bainitic ferrite to 10% or less.
(2) 8% or higher El can be achieved by limiting retained austenite to 5% or more.
(3) A wide range of appropriate clearances for hole expanding deformation can be achieved by limiting the total of ferrite and bainitic ferrite to 10% or less, retained austenite to 15% or less, the carbon concentration in retained austenite to 0.50% or more, and KAM (S)/KAM (C) to less than 1.00 and further Hv (Q)−Hv (S) to 8 or more.
(4) A range of appropriate clearances not leading to delayed fracture can be achieved by limiting KAM (S)/KAM (C) to less than 1.00 and further Hv (Q)−Hv (S) to 8 or more.

Aspects of the present invention have been made based on the above findings. Specifically, a summary of claim components according to aspects of the present invention is as follows.

[1] A high strength steel sheet including a microstructure having a chemical composition including, by mass %:
C: 0.15% or more and 0.45% or less,
Si: 0.50% or more and 2.00% or less,
Mn: 1.50% or more and 3.50% or less,
P: 0.100% or less,
S: 0.0200% or less,
Al: 0.010% or more and 1.000% or less,
N: 0.0100% or less, and
H: 0.0020% or less,
the balance being Fe and incidental impurities;
the microstructure being such that:
the area fraction of tempered martensite is 80% or more,
the volume fraction of retained austenite is 5% or more and 15% or less, the area fraction of the total of ferrite and bainitic ferrite is 10% or less, and the carbon concentration in retained austenite is 0.50% or more;

the microstructure satisfying the formulas (1) and (2) defined below:

$$KAM(S)/KAM(C) < 1.00 \quad (1)$$

wherein KAM (S) is a KAM (Kernel average misorientation) value of a superficial portion of the steel sheet, and KAM (C) is a KAM value of a central portion of the steel sheet, $$Hv(Q) - Hv(S) \geq 8 \quad (2)$$

wherein Hv (Q) indicates the hardness of a portion at ¼ sheet thickness and Hv (S) indicates the hardness of a superficial portion of the steel sheet.

[2] The high strength steel sheet described in [1], wherein the chemical composition further includes one, or two or more elements selected from, by mass %:

Ti: 0.100% or less,
B: 0.0100% or less,
Nb: 0.100% or less,
Cu: 1.00% or less,
Cr: 1.00% or less,
V: 0.100% or less,
Mo: 0.500% or less,
Ni: 0.50% or less,
Sb: 0.200% or less,
Sn: 0.200% or less,
As: 0.100% or less,
Ta: 0.100% or less,
Ca: 0.0200% or less,
Mg: 0.0200% or less,
Zn: 0.020% or less,
Co: 0.020% or less,
Zr: 0.020% or less, and
REM: 0.0200% or less.

[3] The high strength steel sheet described in [1] or [2], which has a coated layer on a surface of the steel sheet.

[4] A method for manufacturing a high strength steel sheet described in [1] or [2], the method including:

providing a cold rolled steel sheet produced by subjecting a steel slab to hot rolling, pickling, and cold rolling;

annealing the steel sheet under conditions where:

a temperature T1 is 850° C. or above and 1000° C. or below and a holding time t1 at T1 is 10 seconds or more and 1000 seconds or less;

cooling the steel sheet to a temperature T2 of 100° C. or above and 300° C. or below;

reheating the steel sheet under conditions where:

a temperature T3 is equal to or higher than T2 and 450° C. or below and a holding time t3 at the temperature T3 is 1.0 second or more and 1000.0 seconds or less;

cooling the steel sheet to 100° C. or below;

starting working at an elapsed time t4 of 1000 seconds or less from the time when the temperature reaches 100° C., the working being performed under conditions where:

a working start temperature T4 is 80° C. or below and an equivalent plastic strain is 0.10% or more and 5.00% or less;

tempering the steel sheet under conditions where:

a temperature T5 is 100° C. or above and 400° C. or below and a holding time t5 at the temperature T5 is 1.0 second or more and 1000.0 seconds or less; and cooling the steel sheet under conditions where a cooling rate θ1 from the temperature T5 to 80° C. is 100° C./sec or less.

[5] The method for manufacturing a high strength steel sheet described in [4], wherein the working before the tempering is performed under conditions where strain is applied by two or more separate working operations, and the total of the equivalent plastic strains applied in the working operations is 0.10% or more.

[6] The method for manufacturing a high strength steel sheet described in [4] or [5], further including performing coating treatment between the annealing and the working.

According to aspects of the present invention, a high strength steel sheet can be obtained that has a TS of 1320 MPa or more and an El of 8% or more and has a wide range of appropriate clearances for hole expanding deformation and a wide range of appropriate clearances not leading to delayed fracture. Furthermore, for example, the high strength steel sheet according to aspects of the present invention may be applied to automobile structural members to reduce the weight of automobile bodies and thereby to enhance fuel efficiency. Thus, aspects of the present invention are highly valuable in industry.

DETAILED DESCRIPTION OF EMBODIMENTS OF THE INVENTION

Embodiments of the present invention will be described below.

First, appropriate ranges of the chemical composition of the high strength steel sheet and the reasons why the chemical composition is thus limited will be described. In the following description, "%" indicating the contents of constituent elements of steel means "mass %" unless otherwise specified.

C: 0.15% or More and 0.45% or Less

Carbon is one of the important basic components of steel, and, particularly in accordance with aspects of the present invention, is an important element that affects TS. If the C content is less than 0.15%, it is difficult to achieve 1320 MPa or higher TS. Thus, the C content is limited to 0.15% or more. The C content is preferably 0.16% or more. The C content is more preferably 0.17% or more. The C content is still more preferably 0.18% or more. The C content is most preferably 0.19% or more. However, if the C content is more than 0.45%, it is difficult to achieve 8.0% or higher El. Thus, the C content is limited to 0.45% or less. The C content is preferably 0.40% or less. The C content is more preferably 0.35% or less. The C content is still more preferably 0.30% or less. The C content is most preferably 0.26% or less.

Si: 0.50% or More and 2.00% or Less

Silicon is one of the important basic components of steel, and, particularly in accordance with aspects of the present invention, is an important element that affects the volume fraction of retained austenite and the carbon concentration in retained austenite. If the Si content is less than 0.50%, a large amount of carbide is precipitated during reheating treatment and tempering treatment to lower the volume fraction of retained austenite and the carbon concentration in retained austenite. As a result, 8.0% or higher El is hardly achieved and the range of appropriate clearances for hole expanding deformation is narrowed. Thus, the Si content is limited to 0.50% or more. The Si content is preferably 0.60% or more. The Si content is more preferably 0.70% or more. However, if the Si content is more than 2.00%, the amount of silicon segregation increases to make the steel sheet brittle and to narrow the range of appropriate clearances not leading to delayed fracture. Thus, the Si content is limited to 2.00% or less. The Si content is preferably 1.95% or less. The Si content is more preferably 1.80% or less. The Si content is still more preferably 1.50% or less.

Mn: 1.50% or More and 3.50% or Less

Manganese is one of the important basic components of steel, and, particularly in accordance with aspects of the present invention, is an important element that affects the fraction of ferrite and the fraction of bainite. If the Mn content is less than 1.50%, the fraction of ferrite and the fraction of bainite increase to narrow the range of appropriate clearances for hole expanding deformation. Thus, the Mn content is limited to 1.50% or more. The Mn content is preferably 1.60% or more. The Mn content is more preferably 1.80% or more. The Mn content is still more preferably 2.00% or more. However, if the Mn content is more than 3.50%, the amount of manganese segregation increases to make the steel sheet brittle and to narrow the range of appropriate clearances not leading to delayed fracture. Thus, the Mn content is limited to 3.50% or less. The Mn content is preferably 3.30% or less. The Mn content is more preferably 3.20% or less. The Mn content is still more preferably 3.00% or less.

P: 0.100% or Less

If the P content is more than 0.100%, phosphorus is segregated at grain boundaries to make the steel sheet brittle and to narrow the range of appropriate clearances not leading to delayed fracture. Thus, the P content is limited to 0.100% or less. The P content is preferably 0.080% or less. The P content is more preferably 0.060% or less. The lower limit of the P content is not particularly limited but is preferably 0.001% or more due to production technology limitations.

S: 0.0200% or Less

If the S content is more than 0.0200%, sulfides are formed making the steel sheet brittle and thereby narrow the range of appropriate clearances not leading to delayed fracture. Thus, the S content is limited to 0.0200% or less. The S content is preferably 0.0100% or less. The S content is more preferably 0.0050% or less. The lower limit of the S content is not particularly limited but is preferably 0.0001% or more due to production technology limitations.

Al: 0.010% or More and 1.000% or Less

The addition of aluminum increases the strength of the steel sheet and facilitates achieving 1320 MPa or higher TS. To obtain these effects, the Al content needs to be 0.010% or more. Thus, the Al content is limited to 0.010% or more. The Al content is preferably 0.012% or more. The Al content is more preferably 0.015% or more. The Al content is still more preferably 0.020% or more. However, if the Al content is more than 1.000%, the fraction of ferrite and the fraction of bainite increase to narrow the range of appropriate clearances for hole expanding deformation. Thus, the Al content is limited to 1.000% or less. The Al content is preferably 0.500% or less. The Al content is more preferably 0.100% or less.

N: 0.0100% or Less

If the N content is more than 0.0100%, the cast slab becomes brittle and is easily cracked to cause a significant decrease in productivity. Thus, the N content is limited to 0.0100% or less. The N content is preferably 0.0080% or less. The N content is more preferably 0.0070% or less. The N content is still more preferably 0.0060% or less. The N content is most preferably 0.0050% or less. The lower limit of the N content is not particularly limited but is preferably 0.0010% or more due to production technology limitations.

H: 0.0020% or Less

If the H content is more than 0.0020%, the steel sheet becomes brittle and the range of appropriate clearances not leading to delayed fracture is narrowed. Thus, the H content is limited to 0.0020% or less. The H content is preferably 0.0015% or less. The H content is more preferably 0.0010% or less. The lower limit of the H content is not particularly limited. The lower the H content, the wider the range of appropriate clearances not leading to delayed fracture. That is, the H content may be 0%.

In addition to the chemical composition described above, the high strength steel sheet according to aspects of the present invention preferably further contains one, or two or more elements selected from, by mass %, Ti: 0.100% or less, B: 0.0100% or less, Nb: 0.100% or less, Cu: 1.00% or less, Cr: 1.00% or less, V: 0.100% or less, Mo: 0.500% or less, Ni: 0.50% or less, Sb: 0.200% or less, Sn: 0.200% or less, As: 0.100% or less, Ta: 0.100% or less, Ca: 0.0200% or less, Mg: 0.0200% or less, Zn: 0.020% or less, Co: 0.020% or less, Zr: 0.020% or less, and REM: 0.0200% or less.

Ti: 0.100% or Less

If the Ti content is more than 0.100%, the cast slab becomes brittle and is easily cracked to cause a significant decrease in productivity. Thus, when titanium is added, the content thereof is limited to 0.100% or less. The Ti content is preferably 0.090% or less. The Ti content is more preferably 0.075% or less. The Ti content is still more preferably 0.050% or less. The Ti content is most preferably less than 0.050%. In contrast, the addition of titanium increases the strength of the steel sheet and facilitates achieving 1320 MPa or higher TS. To obtain these effects, the Ti content is preferably 0.001% or more. The Ti content is more preferably 0.005% or more. The Ti content is still more preferably 0.010% or more.

B: 0.0100% or Less

If the B content is more than 0.0100%, the cast slab becomes brittle and is easily cracked to cause a significant decrease in productivity. Thus, when boron is added, the content thereof is limited to 0.0100% or less. The B content is preferably 0.0080% or less. The B content is more preferably 0.0050% or less. In contrast, the addition of boron increases the strength of the steel sheet and facilitates achieving 1320 MPa or higher TS. To obtain these effects, the B content is preferably 0.0001% or more. The B content is more preferably 0.0002% or more.

Nb: 0.100% or Less

If the Nb content is more than 0.100%, the cast slab becomes brittle and is easily cracked to cause a significant decrease in productivity. Thus, when niobium is added, the content thereof is limited to 0.100% or less. The Nb content is preferably 0.090% or less. The Nb content is more preferably 0.050% or less. The Nb content is still more preferably 0.030% or less. In contrast, the addition of niobium increases the strength of the steel sheet and facilitates achieving 1320 MPa or higher TS. To obtain these effects, the Nb content is preferably 0.001% or more. The Nb content is more preferably 0.002% or more.

Cu: 1.00% or Less

If the Cu content is more than 1.00%, the cast slab becomes brittle and is easily cracked to cause a significant decrease in productivity. Thus, the Cu content is limited to 1.00% or less. The Cu content is preferably 0.50% or less. The Cu content is more preferably 0.30% or less. In contrast, copper suppresses the penetration of hydrogen into the steel sheet and improves the range of appropriate clearances not leading to delayed fracture. To obtain these effects, the Cu content is preferably 0.01% or more. The Cu content is more preferably 0.03% or more.

Cr: 1.00% or Less

If the Cr content is more than 1.00%, large amounts of coarse precipitates and inclusions are formed to lower the ultimate deformability of the steel, thus narrowing the range of appropriate clearances for hole expanding deformation. Thus, when chromium is added, the content thereof is limited to 1.00% or less. The Cr content is preferably 0.70% or less. The Cr content is more preferably 0.50% or less. In contrast, chromium not only serves as a solid solution strengthening element but also can stabilize austenite and suppress ferrite formation in the cooling process during continuous annealing, thus increasing the strength of the steel sheet. To obtain these effects, the Cr content is preferably 0.01% or more. The Cr content is more preferably 0.02% or more.

V: 0.100% or Less

If the V content is more than 0.100%, large amounts of coarse precipitates and inclusions are formed to lower the ultimate deformability of the steel, thus narrowing the range of appropriate clearances for hole expanding deformation. Thus, when vanadium is added, the content thereof is limited to 0.100% or less. The V content is preferably 0.060% or less. In contrast, vanadium increases the strength of the steel sheet. To obtain this effect, the V content is preferably 0.001% or more. The V content is more preferably 0.005% or more. The V content is still more preferably 0.010% or more.

Mo: 0.500% or Less

If the Mo content is more than 0.500%, large amounts of coarse precipitates and inclusions are formed to lower the ultimate deformability of the steel, thus narrowing the range of appropriate clearances for hole expanding deformation. Thus, when molybdenum is added, the content thereof is limited to 0.500% or less. The Mo content is preferably 0.450% or less, and more preferably 0.350% or less. In contrast, molybdenum not only serves as a solid solution strengthening element but also can stabilize austenite and suppress ferrite formation in the cooling process during continuous annealing, thus increasing the strength of the steel sheet. To obtain these effects, the Mo content is preferably 0.010% or more. The Mo content is more preferably 0.020% or more.

Ni: 0.50% or Less

If the Ni content is more than 0.50%, large amounts of coarse precipitates and inclusions are formed to lower the ultimate deformability of the steel, thus narrowing the range of appropriate clearances for hole expanding deformation. Thus, when nickel is added, the content thereof is limited to 0.50% or less. The Ni content is preferably 0.45% or less. The Ni content is more preferably 0.30% or less. In contrast, nickel can stabilize austenite and suppress ferrite formation in the cooling process during continuous annealing, thus increasing the strength of the steel sheet. To obtain these effects, the Ni content is preferably 0.01% or more. The Ni content is more preferably 0.02% or more.

Sb: 0.200% or Less

If the Sb content is more than 0.200%, large amounts of coarse precipitates and inclusions are formed to lower the ultimate deformability of the steel, thus narrowing the range of appropriate clearances for hole expanding deformation. Thus, when antimony is added, the content thereof is limited to 0.200% or less. The Sb content is preferably 0.100% or less. The Sb content is more preferably 0.050% or less. In contrast, antimony suppresses the formation of a soft superficial layer and increases the strength of the steel sheet. To obtain these effects, the Sb content is preferably 0.001% or more. The Sb content is more preferably 0.005% or more.

Sn: 0.200% or Less

If the Sn content is more than 0.200%, large amounts of coarse precipitates and inclusions are formed to lower the ultimate deformability of the steel, thus narrowing the range of appropriate clearances for hole expanding deformation. Thus, when tin is added, the content thereof is limited to 0.200% or less. The Sn content is preferably 0.100% or less. The Sn content is more preferably 0.050% or less. In contrast, tin suppresses the formation of a soft superficial layer and increases the strength of the steel sheet. To obtain these effects, the Sn content is preferably 0.001% or more. The Sn content is more preferably 0.005% or more.

As: 0.100% or Less

If the As content is more than 0.100%, large amounts of coarse precipitates and inclusions are formed to lower the ultimate deformability of the steel, thus narrowing the range of appropriate clearances for hole expanding deformation. Thus, when arsenic is added, the content thereof is limited to 0.100% or less. The As content is preferably 0.060% or less. The As content is more preferably 0.010% or less. Arsenic increases the strength of the steel sheet. To obtain this effect, the As content is preferably 0.001% or more. The As content is more preferably 0.005% or more.

Ta: 0.100% or Less

If the Ta content is more than 0.100%, large amounts of coarse precipitates and inclusions are formed to lower the ultimate deformability of the steel, thus narrowing the range of appropriate clearances for hole expanding deformation. Thus, when tantalum is added, the content thereof is limited to 0.100% or less. The Ta content is preferably 0.050% or less. The Ta content is more preferably 0.010% or less. In contrast, tantalum increases the strength of the steel sheet. To obtain this effect, the Ta content is preferably 0.001% or more. The Ta content is more preferably 0.005% or more.

Ca: 0.0200% or Less

If the Ca content is more than 0.0200%, large amounts of coarse precipitates and inclusions are formed to lower the ultimate deformability of the steel, thus narrowing the range of appropriate clearances for hole expanding deformation. Thus, when calcium is added, the content thereof is limited to 0.0200% or less. The Ca content is preferably 0.0100% or less. Calcium is an element used for deoxidation. Furthermore, this element is effective for controlling the shape of sulfides to spherical, enhancing the ultimate deformability of the steel sheet, and enhancing the range of appropriate clearances not leading to delayed fracture. To obtain these effects, the Ca content is preferably 0.0001% or more.

Mg: 0.0200% or Less

If the Mg content is more than 0.0200%, large amounts of coarse precipitates and inclusions are formed to lower the ultimate deformability of the steel, thus narrowing the range of appropriate clearances for hole expanding deformation. Thus, when magnesium is added, the content thereof is limited to 0.0200% or less. Magnesium is an element used for deoxidation. Furthermore, this element is effective for controlling the shape of sulfides to spherical, enhancing the ultimate deformability of the steel sheet, and enhancing the range of appropriate clearances not leading to delayed fracture. To obtain these effects, the Mg content is preferably 0.0001% or more.

Zn: 0.020% or Less, Co: 0.020% or Less, Zr: 0.020% or Less

If the contents of zinc, cobalt, and zirconium are each more than 0.020%, large amounts of coarse precipitates and inclusions are formed to lower the ultimate deformability of the steel, thus narrowing the range of appropriate clearances for hole expanding deformation. Thus, when zinc, cobalt, and zirconium are added, the contents thereof are each limited to 0.020% or less. In contrast, zinc, cobalt, and zirconium are elements effective for controlling the shape of inclusions to spherical, enhancing the ultimate deformability of the steel sheet, and enhancing the range of appropriate clearances not leading to delayed fracture. To obtain these effects, the contents of zinc, cobalt, and zirconium are preferably each 0.0001% or more.

REM: 0.0200% or Less

If the REM content is more than 0.0200%, large amounts of coarse precipitates and inclusions are formed to lower the ultimate deformability of the steel, thus narrowing the range of appropriate clearances for hole expanding deformation. Thus, when rare earth metals are added, the content thereof is limited to 0.0200% or less. In contrast, rare earth metals are elements effective for controlling the shape of inclusions to spherical, enhancing the ultimate deformability of the steel sheet, and enhancing the range of appropriate clearances not leading to delayed fracture. To obtain these effects, the REM content is preferably 0.0001% or more.

The balance of the composition is Fe and incidental impurities. When the content of any of the above optional elements is below the lower limit, the element does not impair the advantageous effects according to aspects of the present invention. Thus, such an optional element below the lower limit content is regarded as an incidental impurity.

Next, the steel microstructure of the high strength steel sheet according to aspects of the present invention will be described.

Tempered Martensite: 80% or More in Terms of Area Fraction

This requirement is a highly important claim component in accordance with aspects of the present invention. 1320 MPa or higher TS may be achieved by making martensite as the main phase. To obtain this effect, the area fraction of tempered martensite needs to be 80% or more. Thus, the area fraction of tempered martensite is limited to 80% or more. The area fraction of tempered martensite is preferably 85% or more. The area fraction of tempered martensite is more preferably 87% or more. In contrast, the upper limit of the area fraction of tempered martensite is not particularly limited but is preferably 95% or less to ensure an amount of retained austenite.

Here, tempered martensite is measured as follows. A longitudinal cross section of the steel sheet is polished and is subjected to etching in 3 vol % Nital solution. A portion at ¼ sheet thickness (a location corresponding to ¼ of the sheet thickness in the depth direction from the steel sheet surface) is observed using SEM in 10 fields of view at a magnification of ×2000. In the microstructure images, tempered martensite is structures that have fine irregularities inside the structures and contain carbides within the structures. The values thus obtained are averaged to determine the area fraction of tempered martensite.

Retained Austenite: 5% or More and 15% or Less in Terms of Volume Fraction

This requirement is a highly important claim component in accordance with aspects of the present invention. If the volume fraction of retained austenite is less than 5%, it is difficult to achieve 8.0% or higher El. Thus, the volume fraction of retained austenite is limited to 5% or more. The volume fraction of retained austenite is preferably 6% or more. The volume fraction of retained austenite is more preferably 7% or more. However, if retained austenite represents more than 15%, the ultimate deformability of the steel sheet is lowered and the range of appropriate clearances for hole expanding deformation is narrowed. Thus, the volume fraction of retained austenite is limited to 15% or less. The volume fraction of retained austenite is preferably 14% or less. The volume fraction of retained austenite is more preferably 12% or less. The volume fraction of retained austenite is still more preferably 10% or less.

Here, retained austenite is measured as follows. The steel sheet was polished to expose a face 0.1 mm below ¼ sheet thickness and was thereafter further chemically polished to expose a face 0.1 mm below the face exposed above. The face was analyzed with an X-ray diffractometer using CoKα radiation to determine the integral intensity ratios of the diffraction peaks of {200}, {220}, and {311} planes of fcc iron and {200}, {211}, and {220} planes of bcc iron. Nine integral intensity ratios thus obtained were averaged to determine the volume fraction of retained austenite.

Total of Ferrite and Bainitic Ferrite: 10% or Less in Terms of Area Fraction This requirement is a highly important claim component in accordance with aspects of the present invention. If the area fraction of the total of ferrite and bainitic ferrite is more than 10%, the ultimate deformability of the steel sheet is lowered and the range of appropriate clearances for hole expanding deformation is narrowed. Thus, the area fraction of the total of ferrite and bainitic ferrite is limited to 10% or less. The area fraction of the total of ferrite and bainitic ferrite is preferably 8% or less. The area fraction of the total of ferrite and bainitic ferrite is more preferably 5% or less. The lower limit of the total of ferrite and bainitic ferrite is not particularly limited. A smaller fraction is more preferable. The lower limit of the total of ferrite and bainitic ferrite may be 0%.

Here, the total of ferrite and bainitic ferrite is measured as follows. A longitudinal cross section of the steel sheet is polished and is subjected to etching in 3 vol % Nital solution. A portion at ¼ sheet thickness (a location corresponding to ¼ of the sheet thickness in the depth direction from the steel sheet surface) is observed using SEM in 10 fields of view at a magnification of ×2000. In the microstructure images, ferrite and bainitic ferrite are recessed structures with a flat interior. The values thus obtained are averaged to determine the total of the area fraction of ferrite and the area fraction of bainitic ferrite.

Carbon Concentration in Retained Austenite: 0.50% or More

This requirement is a highly important claim component in accordance with aspects of the present invention. If the carbon concentration in retained austenite is less than 0.50%, retained austenite is poorly stable and undergoes transformation into hard martensite at an early stage of deformation, thus narrowing the range of appropriate clearances for hole expanding deformation. Thus, the carbon concentration in retained austenite is limited to 0.50% or more. The carbon concentration in retained austenite is preferably 0.60% or more. The upper limit is preferably 1.00% or less due to production technology limitations.

Here, the carbon concentration Cy in retained austenite is measured as follows. First, the lattice constant of retained austenite was calculated from the amount of diffraction peak shift of {220} plane of austenite using the formula (3), and the lattice constant of retained austenite thus obtained was substituted into the formula (4) to calculate the carbon concentration in retained austenite.

$$a = 1.79021\sqrt{2}/\sin\theta \tag{3}$$

$$a = 3.578 + 0.00095[\mathrm{Mn}] + 0.022[\mathrm{N}] + 0.0006[\mathrm{Cr}] + 0.0031[\mathrm{Mo}] + 0.0051[\mathrm{Nb}] + 0.0039[\mathrm{Ti}] + 0.0056[\mathrm{Al}] + 0.033[\mathrm{C}] \tag{4}$$

Here, a is the lattice constant (Å) of retained austenite, θ is the diffraction peak angle of {220} plane divided by 2 (rad), and [M] is the mass % of the element M in retained austenite. In accordance with aspects of the present invention, mass % of the elements M in retained austenite other than carbon is mass % in the whole of the steel.

$$KAM\ (S)/KAM\ (C) < 1.00 \tag{1}$$

KAM (S): KAM (kernel average misorientation) value of a superficial portion of the steel sheet, KAM (C): KAM value of a central portion of the steel sheet This requirement is a highly important claim component in accordance with aspects of the present invention. The superficial portion of the steel sheet is located 100 μm below the steel sheet surface toward the center of the sheet thickness. The central portion of the steel sheet is located at ½ of the sheet thickness. Studies by the present inventors have revealed that varied distributions of dislocations from the superficial portion to the inside, specifically, KAM (S)/KAM (C) of less than 1.00 is effective for improving the range of appropriate clearances for hole expanding deformation and the range of appropriate clearances not leading to delayed fracture. Thus, KAM (S)/KAM (C) is limited to less than 1.00. The lower limit of KAM (S)/KAM (C) is not particularly limited but is preferably 0.80 or more due to production technology limitations.

Here, the KAM values are measured as follows. First, a test specimen for microstructure observation was sampled from the cold rolled steel sheet. Next, the sampled test specimen was polished by vibration polishing with colloidal silica to expose a cross section in the rolling direction (a longitudinal cross section) for use as observation surface. The observation surface was specular. Next, electron backscatter diffraction (EBSD) measurement was performed. Local crystal orientation data was thus obtained. Here, the SEM magnification was ×3000, the step size was 0.05 μm, the measured region was 20 μm square, and the WD was 15 mm. The local orientation data obtained was analyzed with analysis software: OIM Analysis 7. The analysis was performed with respect to 10 fields of view of the portion at the target sheet thickness, and the results were averaged.

Prior to the data analysis, cleanup was performed sequentially once using Grain Dilation function of the analysis software (Grain Tolerance Angle: 5, Minimum Grain Size: 2, Single Iteration: ON) and once with Grain CI Standardization function (Grain Tolerance Angle: 5, Minimum Grain Size: 5). Subsequently, measurement points with a CI value>0.1 were exclusively used for the analysis. The KAM values were displayed as a chart, and the average KAM value of the bcc phase was determined. The analysis here was performed under the following conditions:

Nearest neighbor: 1st,
Maximum misorientation: 5,
Perimeter only, and
Check Set 0-point kernels to maximum misorientation.

$$Hv\ (Q) - Hv\ (S) \geq 8\ Hv$$

(Q): hardness of a portion at ¼ sheet thickness, Hv (S): hardness of a superficial portion of the steel sheet This requirement is a highly important claim component in accordance with aspects of the present invention. The superficial portion of the steel sheet is located 100 μm below the steel sheet surface toward the center of the sheet thickness. Studies by the present inventors have revealed that variations in hardness from the superficial portion to the inside, specifically, Hv (Q)−Hv (S) of 8 or more is effective for improving the range of appropriate clearances for hole expanding deformation and the range of appropriate clearances not leading to delayed fracture. Thus, Hv (Q)−Hv (S) is limited to 8 or more. Hv (Q)−Hv (S) is preferably 9 or more. Hv (Q)−Hv (S) is more preferably 10 or more. The upper limit of Hv (Q)−Hv (S) is not particularly limited but is preferably 30 or less due to production technology limitations. Preferred ranges of Hv (Q) and Hv (S) are 400 to 600 and 400 to 600, respectively.

Here, the hardness is measured as follows. First, a test specimen for microstructure observation was sampled from the cold rolled steel sheet. Next, the sampled test specimen was polished to expose a cross section in the rolling direction (a longitudinal cross section) for use as observation surface. The observation surface was specular. Next, the hardness was determined using a Vickers tester with a load of 1 kg. The hardness was measured with respect to 10 points at 20 μm intervals at the target sheet thickness. The values of 8 points excluding the maximum hardness and the minimum hardness were averaged.

Next, a manufacturing method according to aspects of the present invention will be described.

In accordance with aspects of the present invention, a steel material (a steel slab) may be obtained by any known steelmaking method without limitation, such as a converter or an electric arc furnace. To prevent macro-segregation, the steel slab (the slab) is preferably produced by a continuous casting method.

In accordance with aspects of the present invention, the slab heating temperature, the slab soaking holding time, and the coiling temperature in hot rolling are not particularly limited. For example, the steel slab may be hot rolled in such a manner that the slab is heated and is then rolled, that the slab is subjected to hot direct rolling after continuous casting without being heated, or that the slab is subjected to a short heat treatment after continuous casting and is then rolled. The slab heating temperature, the slab soaking holding time, the finish rolling temperature, and the coiling temperature in hot rolling are not particularly limited. The slab heating temperature is preferably 1100° C. or above. The slab heating temperature is preferably 1300° C. or below. The slab soaking holding time is preferably 30 minutes or more. The slab soaking holding time is preferably 250 minutes or less. The finish rolling temperature is preferably $Ar_3$ transformation temperature or above. The coiling temperature is preferably 350° C. or above. The coiling temperature is preferably 650° C. or below.

The hot rolled steel sheet thus produced is pickled. Pickling can remove oxides on the steel sheet surface and is thus important to ensure good chemical convertibility and a high quality of coating in the final high strength steel sheet. Pickling may be performed at a time or several. The hot rolled sheet that has been pickled may be cold rolled directly or may be subjected to heat treatment before cold rolling.

The rolling reduction in cold rolling and the sheet thickness after rolling are not particularly limited. The rolling reduction in cold rolling is preferably 30% or more. The rolling reduction in cold rolling is preferably 80% or less. The advantageous effects according to aspects of the present invention may be obtained without limitations on the number of rolling passes and the rolling reduction in each pass.

The cold rolled steel sheet obtained as described above is annealed. Annealing conditions are as follows.

Annealing Temperature T1: 850° C. or Above and 1000° C. or Below

This requirement is a highly important claim component in accordance with aspects of the present invention. If the annealing temperature T1 is below 850° C., the area fraction of the total of ferrite and bainitic ferrite exceeds 10% and the range of appropriate clearances for hole expanding deformation is narrowed. Thus, the annealing temperature T1 is limited to 850° C. or above. The annealing temperature T1 is preferably 860° C. or above. However, if the annealing temperature T1 is higher than 1000° C., the prior-austenite grain size excessively increases and the range of appropriate clearances not leading to delayed fracture is narrowed. Thus, the annealing temperature T1 is limited to 1000° C. or below. The annealing temperature T1 is preferably 970° C. or below. The annealing temperature T1 is more preferably 950° C. or below. The annealing temperature T1 is still more preferably 900° C. or below.

Holding Time t1 at the Annealing Temperature T1: 10 Seconds or More and 1000 Seconds or Less If the holding time t1 at the annealing temperature T1 is less than 10 seconds, austenitization is insufficient with the result that the area fraction of the total of ferrite and bainitic ferrite exceeds 10% and the range of appropriate clearances for hole expanding deformation is narrowed. Thus, the holding time t1 at the annealing temperature T1 is limited to 10 seconds or more. The holding time t1 at the annealing temperature T1 is preferably 30 seconds or more. t1 is more preferably 45 seconds or more. t1 is still more preferably 60 seconds or more. t1 is most preferably 100 seconds or more. However, if the holding time at the annealing temperature T1 is longer than 1000 seconds, the prior-austenite grain size excessively increases and the range of appropriate clearances not leading to delayed fracture is narrowed. Thus, the holding time t1 at the annealing temperature T1 is limited to 1000 seconds or less. The holding time t1 at the annealing temperature T1 is preferably 800 seconds or less. The holding time t1 at the annealing temperature T1 is more preferably 500 seconds or less. The holding time t1 at the annealing temperature T1 is still more preferably 300 seconds or less.

Finish Cooling Temperature T2: 100° C. or Above and 300° C. or Below

This requirement is a highly important claim component in accordance with aspects of the present invention. If the finish cooling temperature T2 is lower than 100° C., martensite transformation proceeds excessively with the result that retained austenite represents less than 5% and 8% or higher El is hardly achieved. Thus, the finish cooling temperature T2 is limited to 100° C. or above. The finish cooling temperature T2 is preferably 150° C. or above. The finish cooling temperature T2 is more preferably 180° C. or above. However, if the finish cooling temperature T2 is higher than 300° C., martensite transformation is insufficient with the result that retained austenite represents more than 15% and the range of appropriate clearances for hole expanding deformation is narrowed. Thus, the finish cooling temperature T2 is limited to 300° C. or below. The finish cooling temperature T2 is preferably 250° C. or below.

Reheating Temperature T3: Equal to or Higher than T2 and 450° C. or Below

This requirement is a highly important claim component in accordance with aspects of the present invention. After the cooling is finished, the steel sheet is held at the temperature or is reheated and is held at a temperature of 450° C. or below to stabilize retained austenite. If the temperature is lower than T2, desired retained austenite cannot be obtained. Thus, the reheating temperature T3 is limited to T2 or above. The reheating temperature T3 is preferably 300° C. or above. If the reheating temperature T3 is higher than 450° C., bainite transformation proceeds excessively with the result that the area fraction of the total of ferrite and bainitic ferrite exceeds 10% and the range of appropriate clearances for hole expanding deformation is narrowed. Thus, the reheating temperature T3 is limited to 450° C. or below. The reheating temperature T3 is preferably 420° C. or below. The reheating temperature T3 is more preferably 400° C. or below.

Holding Time t3 at the Reheating Temperature T3: 1.0 Second or More and 1000.0 Seconds or Less This requirement is a highly important claim component in accordance with aspects of the present invention. After the cooling is finished, the steel sheet is held at the temperature or is reheated and is held at a temperature of 450° C. or below to stabilize retained austenite. If the holding time t3 at the reheating temperature T3 is less than 1.0 second, the stabilization of retained austenite is insufficient with the result that the amount of retained austenite decreases and 8% or higher El is hardly achieved. Thus, the holding time t3 at the reheating temperature T3 is limited to 1.0 second or more. The holding time t3 at the reheating temperature T3 is preferably 5.0 seconds or more. The holding time t3 at the reheating temperature T3 is more preferably 100.0 seconds or more. The holding time t3 at the reheating temperature T3 is still more preferably 150.0 seconds or more. However, if the holding time t3 at the reheating temperature T3 is longer than 1000.0 seconds, bainite transformation proceeds excessively with the result that the total of ferrite and bainitic ferrite exceeds 10% and the range of appropriate clearances for hole expanding deformation is narrowed. Thus, the holding time t3 during reheating, that is, at the reheating temperature T3 is limited to 1000.0 seconds or less. The holding time t3 at the reheating temperature T3 is preferably 500.0 seconds or less. The holding time t3 at the reheating temperature T3 is preferably 300.0 seconds or less.

Cooling to 100° C. or Below after Reheating

In the step of cooling to 100° C. or below, austenite is transformed into martensite. To obtain 80% or more tempered martensite, the reheated steel sheet needs to be cooled to 100° C. or below. Thus, reheating is followed by cooling to 100° C. or below. The finish cooling temperature after reheating is preferably 0° C. or above due to production technology limitations.

Elapsed Time t4 from the Time when the Temperature Reaches 100° C. Until the Start of Working: 1000 Seconds or Less This requirement is a highly important claim component in accordance with aspects of the present invention. If the elapsed time t4 from the time when the temperature reaches 100° C. until the start of working is longer than 1000 seconds, aging of martensite microstructure proceeds excessively and varied amounts of strains are introduced by working into the superficial portion of the steel sheet and the central portion of the steel sheet with the result that KAM (S)/KAM (C) becomes 1.00 or more, and the range of appropriate clearances for hole expanding deformation and the range of appropriate clearances not leading to delayed fracture are narrowed. Thus, the elapsed time t4 from the time when the temperature reaches 100° C. until the start of working is limited to 1000 seconds or less. The elapsed time t4 from the time when the temperature reaches 100° C. until the start of working is preferably 900 seconds or less. The elapsed time t4 from the time when the temperature reaches 100° C. until the start of working is more preferably 800 seconds or less. The lower limit is not particularly limited. It is, however, preferable that the elapsed time t4 from the time when the temperature reaches 100° C. until the start of working be 5 seconds or more due to production technology limitations. Studies by the present inventors have shown that the elapsed time from the time when the temperature reaches 100° C. until the end of working does not affect the amounts of strains introduced by working into the superficial portion of the steel sheet and the central portion of the steel sheet.

Working Start Temperature T4: 80° C. or Below

This requirement is a highly important claim component in accordance with aspects of the present invention. If the working start temperature T4 is higher than 80° C., the steel sheet is soft and working introduces varied amounts of strains into the superficial portion of the steel sheet and the central portion of the steel sheet with the result that KAM (S)/KAM (C) becomes 1.00 or more, and the range of appropriate clearances for hole expanding deformation and the range of appropriate clearances not leading to delayed fracture are narrowed. Thus, the working start temperature T4 is limited to 80° C. or below. The working start temperature T4 is preferably 60° C. or below. The working start temperature T4 is more preferably 50° C. or below. The lower limit is not particularly limited but is preferably 0° C. or above due to production technology limitations.

Equivalent Plastic Strain: 0.10% or More and 5.00% or Less

This requirement is a highly important claim component in accordance with aspects of the present invention. If the equivalent plastic strain is less than 0.10%, the amount of working is small, and KAM (S)/KAM (C) becomes 1.00 or more and further the carbon concentration in retained austenite becomes less than 0.50% with the result that the range of appropriate clearances for hole expanding deformation and the range of appropriate clearances not leading to delayed fracture are narrowed. Thus, the equivalent plastic strain is limited to 0.10% or more. The equivalent plastic strain is preferably 0.15% or more. The equivalent plastic strain is more preferably 0.30% or more. However, if the equivalent plastic strain is more than 5.00%, retained austenite represents less than 5% and 8% or higher El is hardly achieved. Thus, the equivalent plastic strain is limited to 5.00% or less. The equivalent plastic strain is preferably 3.00% or less. The equivalent plastic strain is more preferably 1.00% or less.

The working step before tempering may be performed under conditions where strain is applied by two or more separate working operations, and the total of the equivalent plastic strains applied in the working operations is 0.10% or more.

When the equivalent plastic strain in the first working operation is less than 0.10%, the total of the equivalent plastic strains may be brought to 0.10% or more by the second and subsequent working operations. Even in this case, KAM (S)/KAM (C) becomes less than 1.00, and the range of appropriate clearances for hole expanding deformation and the range of appropriate clearances not leading to delayed fracture are enhanced. Thus, the working step before tempering may apply strain by two or more separate working operations as long as the total of the equivalent plastic strains applied in the working operations is 0.10% or more. If the total of the equivalent plastic strains applied in the working operations is more than 5.00%, retained austenite represents less than 5% and 8% or higher El is hardly achieved. Thus, the working step before tempering may apply strain by two or more separate working operations as long as the total of the equivalent plastic strains applied in the working operations is 5.00% or less. The upper limit of the number of working operations is not particularly limited but is preferably 30 or less due to production technology limitations. Incidentally, there is no limitation on the elapsed time from when the temperature reaches 100° C. until the start of the second and subsequent working operations, because the mobility of dislocations in martensite has been lowered by the first working operation.

Here, the working process may be typically temper rolling or tension leveling. The equivalent plastic strain in temper rolling is the ratio by which the steel sheet is elongated and may be determined from the change in the length of the steel sheet before and after the working. The equivalent plastic strain of the steel sheet in leveler processing was calculated by the method of Reference 1 below. The data inputs described below were used in the calculation. Regarding the work hardening behavior, the material was assumed to be a linear hardening elastoplastic material. Bausinger hardening and the decrease in tension due to bend loss were ignored. Misaka's formula was used as the formula of bending curvature.

Sheet thickness breakdown: 31 divisions
Young's modulus: 21000 kgf/mm$^2$
Poisson's ratio: 0.3
Yield stress: 111 kgf/mm$^2$
Plastic coefficient: 1757 kgf/mm$^2$

[Reference 1] Yoshisuke Misaka, Takeshi Masui; Sosei to Kakou (Journal of JSTP), 17 (1976), 988.

Incidentally, the working may be any common strain imparting technique other than those described above. For example, the working may be performed with a continuous stretcher leveler or a roller leveler.

Tempering Temperature T5: 100° C. or Above and 400° C. or Below

This requirement is a highly important claim component in accordance with aspects of the present invention. If the tempering temperature T5 is lower than 100° C., the carbon diffusion distance is so short that the hardness of the steel sheet surface and the inside of the steel sheet is lowered and Hv (Q)−Hv (S) becomes less than 8 with the result that the range of appropriate clearances for hole expanding deformation and the range of appropriate clearances not leading to delayed fracture are narrowed. Thus, the tempering temperature T5 is limited to 100° C. or above. The tempering temperature T5 is preferably 150° C. or above. However, if the tempering temperature T5 is higher than 400° C., tempering of martensite proceeds to make it difficult to achieve 1320 MPa or higher TS. Thus, the tempering temperature T5 is limited to 400° C. or below. The tempering temperature T5 is preferably 350° C. or below. The tempering temperature T5 is more preferably 300° C. or below.

Holding Time t5 at the Tempering Temperature T5: 1.0 Second or More and 1000.0 Seconds or Less This requirement is a highly important claim component in accordance with aspects of the present invention. If the holding time t5 at the tempering temperature T5 is less than 1.0 second, the carbon diffusion distance is so short that the hardness of the steel sheet surface and the inside of the steel sheet is lowered and Hv (Q)−Hv (S) becomes less than 8 with the result that the range of appropriate clearances for hole expanding deformation and the range of appropriate clearances not leading to delayed fracture are narrowed. Thus, the holding time t5 at the tempering temperature T5 is limited to 1.0 second or more. The holding time t5 at the tempering temperature T5 is preferably 5.0 seconds or more. The holding time t5 at the tempering temperature T5 is more preferably 100.0 seconds or more. However, if the holding time t5 at the tempering temperature T5 is longer than 1000.0 seconds, tempering of martensite proceeds to make it difficult to achieve 1320 MPa or higher TS. Thus, the holding time t5 at the tempering temperature T5 is limited to 1000.0 seconds or less. The holding time t5 at the tempering temperature T5 is preferably 800.0 seconds or less. The holding time t5 at the tempering temperature T5 is more preferably 600.0 seconds or less.

Cooling Rate θ1 from the Tempering Temperature T5 to 80° C.: 100° C./Sec or Less This requirement is a highly important claim component in accordance with aspects of the present invention. If the cooling rate θ01 from the tempering temperature T5 to 80° C. is higher than 100° C./sec, the carbon diffusion distance is so short that the hardness of the steel sheet surface and the inside of the steel sheet is lowered and Hv (Q)−Hv (S) becomes less than 8 with the result that the range of appropriate clearances for hole expanding deformation and the range of appropriate clearances not leading to delayed fracture are narrowed. Thus, the cooling rate θ1 from the tempering temperature T5 to 80° C. is limited to 100° C./sec or less. The cooling rate θ1 from the tempering temperature T5 to 80° C. is preferably 50° C./sec or less. The lower limit of the cooling rate θ1 from the tempering temperature T5 to 80° C. is not particularly limited but is preferably 10° C./sec or more due to production technology limitations.

Below 80° C., cooling is not particularly limited and the steel sheet may be cooled to a desired temperature in an appropriate manner. Incidentally, the desired temperature is preferably about room temperature.

Furthermore, the high strength steel sheet described above may be worked again under conditions where the amount of equivalent plastic strain is 0.10% or more and 5.00% or less. Here, the target amount of equivalent plastic strain may be applied at a time or several.

When the high strength steel sheet is a product that is traded, the steel sheet is usually traded after being cooled to room temperature.

In accordance with aspects of the present invention, the high strength steel sheet may be subjected to coating treatment between annealing and working. The phrase "between annealing and working" means a period from the end of the holding time t1 at the annealing temperature T1 until when the temperature reaches the working start temperature T4. For example, the coating treatment during annealing may be hot-dip galvanizing treatment and alloying treatment following the hot-dip galvanizing treatment which are performed when the steel sheet that has been held at the annealing temperature T1 is being cooled to 300° C. or below. For example, the coating treatment between annealing and working may be Zn—Ni electrical alloying coating treatment or pure Zn electroplated coating treatment after reheating. A coated layer may be formed by electroplated coating, or hot-dip zinc-aluminum-magnesium alloy coating may be applied. In the above coating treatment, examples were described focusing on zinc coating, the types of coating metals, such as Zn coating and Al coating, are not particularly limited. Other conditions in the manufacturing method are not particularly limited. From the point of view of productivity, the series of treatments including annealing, hot-dip galvanizing, and alloying treatment of the coated zinc layer is preferably performed on hot-dip galvanizing line, that is CGL (continuous galvanizing line). To control the coating weight of the coated layer, the hot-dip galvanizing treatment may be followed by wiping. Conditions for operations, such as coating, other than those conditions described above may be determined in accordance with the usual hot-dip galvanizing technique.

After the coating treatment between annealing and working, the steel sheet may be worked under conditions where the amount of equivalent plastic strain is 0.10% or more and 5.00 or less. Here, the target amount of equivalent plastic strain may be applied at a time or several.

EXAMPLES

Steels having a chemical composition described in Table 1-1 or Table 1-2, with the balance being Fe and incidental impurities, were smelted in a converter and were continuously cast into slabs. Next, the slabs obtained were heated, hot rolled, pickled, cold rolled, and subjected to annealing treatment, cooling, reheating treatment, working, and tempering treatment described in Table 2-1, Table 2-2, and Table 2-3. High strength cold rolled steel sheets having a sheet thickness of 0.6 to 2.2 mm were thus obtained. Incidentally, some of the steel sheets were subjected to coating treatment after annealing.

In EXAMPLES Nos. 77, 82, 85, 88, and 91, the slabs fractured in the casting step and thus the test was discontinued.

The high strength cold rolled steel sheets obtained as described above were used as test steels. Tensile characteristics and delayed fracture resistance were evaluated in accordance with the following test methods.

Microstructure Observation

The area fraction of tempered martensite, the volume fraction of retained austenite, the total of the area fraction of ferrite and the area fraction of bainitic ferrite, and the carbon concentration in retained austenite were determined in accordance with the methods described hereinabove.

KAM Values

The KAM value of a superficial portion of the steel sheet and the KAM value of a central portion of the steel sheet were determined in accordance with the method described hereinabove.

Hardness Test

The hardness of a portion at ¼ sheet thickness and the hardness of a superficial portion of the steel sheet were determined in accordance with the method described hereinabove.

Tensile Test

A JIS No. 5 test specimen (gauge length: 50 mm, width of parallel portion: 25 mm) was sampled so that the longitudinal direction of the test specimen would be perpendicular to the rolling direction. A tensile test was performed in accordance with JIS Z 2241 under conditions where the crosshead speed was $1.67\times10^{-1}$ mm/sec. TS and El were thus measured. In accordance with aspects of the present invention, 1320 MPa or higher TS was judged to be acceptable, and 8% or higher El was judged to be acceptable.

Range of Appropriate Clearances for Hole Expanding Deformation

The range of appropriate clearances for hole expanding deformation was determined by the following method. The steel sheets obtained were each cut to give 100 mm×100 mm test specimens. A hole with a diameter of 10 mm was punched in the center of the test specimens. The punching clearance was changed from 5 to 10, 15, 20, 25, 30, and 35%. While holding the test specimen on a die having an inner diameter of 75 mm with a blank holder force of 9 tons (88.26 kN), a conical punch with an apex angle of 60° was pushed into the hole until cracking occurred. The hole expansion ratio was determined. Hole expansion ratio: $\lambda(\%)=\{(D_{f1}-D_0)/D_0\}\times100$ where $D_{f1}$ is the hole diameter (mm) at the occurrence of cracking, and $D_0$ is the initial hole diameter (mm). The rating was "x" when the shear clearances that gave λ of 20% or more ranged below 10%. The rating was "○" when the shear clearances ranged to 10% or above but below 15%. The rating was "◎" when the shear clearances ranged to 15% or above. The range of appropriate clearances for hole expanding deformation was evaluated as excellent when the shear clearances that gave λ of 20% or more ranged to 10% or above.

Range of Appropriate Clearances not Leading to Delayed Fracture

The range of appropriate clearances not leading to delayed fracture was determined by the following method. Test specimens having a size of 16 mm×75 mm were prepared by shearing in such a manner that the longitudinal direction would be perpendicular to the rolling direction. The rake angle in the shearing process was constant at 0°, and the shear clearance was changed from 5 to 10, 15, 20, 25, 30, and 35%. The test specimens were four-point loaded in accordance with ASTM (G39-99) so that 1000 MPa stress was applied to the bend apex. The loaded test specimens were immersed in pH 3 hydrochloric acid at 25° C. for 100 hours. The rating was "x" when the shear clearances that did not cause cracking ranged below 10%. The rating was "○" when the shear clearances ranged to 10% or above but below 15%. The rating was "◎" when the shear clearances that did not cause cracking ranged to 15% or above. The range of appropriate clearances not leading to delayed fracture was evaluated as excellent when the shear clearances that did not cause cracking ranged to 10% or above.

As described in Table 3-1, Table 3-2, and Table 3-3, INVENTIVE EXAMPLES achieved 1320 MPa or higher TS, El≥8%, and excellent ranges of appropriate clearances for hole expanding deformation and of appropriate clearances not leading to delayed fracture. In contrast, COMPARATIVE EXAMPLES were unsatisfactory in one or more of TS, El, the range of appropriate clearances for hole expanding deformation, and the range of appropriate clearances not leading to delayed fracture.

TABLE 1-1

| | Chemical composition (mass %) | | | | | | | | | | | | | |
|---|---|---|---|---|---|---|---|---|---|---|---|---|---|---|
| Steels | C | Si | Mn | P | S | Al | N | H | Ti | B | Nb | Cu | Others | Remarks |
| A | 0.21 | 1.00 | 2.76 | 0.010 | 0.0013 | 0.011 | 0.0027 | 0.0000 | 0.014 | | | | | Compliant steel |
| B | 0.21 | 0.62 | 2.85 | 0.010 | 0.0009 | 0.042 | 0.0054 | 0.0000 | | | | | | Compliant steel |
| C | 0.20 | 0.86 | 3.02 | 0.015 | 0.0007 | 0.053 | 0.0034 | 0.0000 | | 0.0028 | | | | Compliant steel |
| D | 0.20 | 0.93 | 3.09 | 0.005 | 0.0014 | 0.050 | 0.0026 | 0.0000 | | | 0.015 | | | Compliant steel |
| E | 0.22 | 0.62 | 2.66 | 0.006 | 0.0008 | 0.046 | 0.0032 | 0.0000 | | | | | | Compliant steel |
| F | 0.16 | 0.93 | 2.68 | 0.013 | 0.0006 | 0.040 | 0.0064 | 0.0000 | | | | 0.18 | | Compliant steel |
| G | 0.14 | 0.84 | 3.14 | 0.011 | 0.0014 | 0.012 | 0.0021 | 0.0000 | | | | | | Comparative steel |
| H | 0.44 | 0.89 | 2.86 | 0.008 | 0.0010 | 0.050 | 0.0013 | 0.0000 | | 0.0018 | | | | Compliant steel |
| I | 0.46 | 0.65 | 2.62 | 0.013 | 0.0006 | 0.048 | 0.0051 | 0.0000 | | | | | | Comparative steel |
| J | 0.23 | 0.51 | 2.99 | 0.005 | 0.0012 | 0.046 | 0.0049 | 0.0000 | | | | 0.13 | | Compliant steel |
| K | 0.21 | 0.14 | 2.76 | 0.009 | 0.0014 | 0.018 | 0.0053 | 0.0000 | | | | | | Comparative steel |
| L | 0.21 | 1.92 | 2.81 | 0.011 | 0.0012 | 0.050 | 0.0017 | 0.0000 | 0.015 | 0.0025 | | | | Compliant steel |
| M | 0.24 | 2.13 | 2.83 | 0.010 | 0.0014 | 0.041 | 0.0054 | 0.0000 | | | | | | Comparative steel |
| N | 0.21 | 0.65 | 1.58 | 0.015 | 0.0014 | 0.021 | 0.0046 | 0.0000 | | | | | | Compliant steel |
| O | 0.22 | 0.80 | 1.42 | 0.011 | 0.0007 | 0.054 | 0.0057 | 0.0000 | | | | | | Comparative steel |
| P | 0.24 | 0.69 | 3.42 | 0.011 | 0.0010 | 0.056 | 0.0056 | 0.0000 | | | | | | Compliant steel |
| Q | 0.23 | 0.65 | 3.65 | 0.011 | 0.0008 | 0.038 | 0.0037 | 0.0000 | | | | | | Comparative steel |
| R | 0.21 | 0.78 | 3.06 | 0.099 | 0.0007 | 0.040 | 0.0063 | 0.0000 | | | | | | Compliant steel |
| S | 0.23 | 0.88 | 2.80 | 0.121 | 0.0012 | 0.024 | 0.0066 | 0.0000 | | | | | | Comparative steel |
| T | 0.24 | 0.86 | 2.96 | 0.014 | 0.0182 | 0.059 | 0.0032 | 0.0000 | | | | | | Compliant steel |
| U | 0.21 | 0.74 | 2.77 | 0.008 | 0.0222 | 0.056 | 0.0058 | 0.0000 | | | | | | Comparative steel |
| V | 0.23 | 0.84 | 2.69 | 0.007 | 0.0009 | 0.976 | 0.0032 | 0.0000 | | | | | | Compliant steel |
| W | 0.20 | 0.91 | 3.07 | 0.006 | 0.0013 | 1.135 | 0.0034 | 0.0000 | | | | | | Comparative steel |
| X | 0.23 | 0.66 | 2.64 | 0.014 | 0.0006 | 0.047 | 0.0089 | 0.0000 | | | | | | Compliant steel |
| Y | 0.24 | 0.73 | 2.96 | 0.008 | 0.0009 | 0.011 | 0.0112 | 0.0000 | | | | | | Comparative steel |
| Z | 0.23 | 0.76 | 2.83 | 0.009 | 0.0007 | 0.018 | 0.0013 | 0.0012 | | | | | | Compliant steel |

Underlines indicate being outside of the range of the present invention.
Blanks indicate that the element was not added intentionally.

TABLE 1-2

| | Chemical composition (mass %) | | | | | | | | | | | | | |
|---|---|---|---|---|---|---|---|---|---|---|---|---|---|---|
| Steels | C | Si | Mn | P | S | Al | N | H | Ti | B | Nb | Cu | Others | Remarks |
| AA | 0.20 | 0.79 | 2.62 | 0.013 | 0.0012 | 0.050 | 0.0041 | 0.0035 | | | | | | Comparative steel |
| AB | 0.23 | 0.60 | 2.63 | 0.010 | 0.0014 | 0.049 | 0.0053 | 0.0000 | | 0.0023 | 0.017 | 0.11 | | Compliant steel |
| AC | 0.22 | 0.60 | 2.62 | 0.006 | 0.0008 | 0.054 | 0.0063 | 0.0000 | 0.085 | 0.0016 | 0.017 | 0.18 | | Compliant steel |
| AD | 0.23 | 0.70 | 2.80 | 0.011 | 0.0012 | 0.050 | 0.0052 | 0.0000 | 0.125 | 0.0013 | 0.018 | 0.15 | | Comparative steel |
| AE | 0.23 | 0.98 | 2.76 | 0.010 | 0.0014 | 0.046 | 0.0041 | 0.0000 | 0.023 | | 0.021 | 0.19 | | Compliant steel |
| AF | 0.20 | 0.88 | 2.84 | 0.012 | 0.0008 | 0.012 | 0.0022 | 0.0000 | 0.035 | 0.0076 | 0.025 | 0.12 | | Compliant steel |
| AG | 0.23 | 0.69 | 3.02 | 0.008 | 0.0005 | 0.057 | 0.0018 | 0.0000 | 0.024 | 0.0124 | 0.025 | 0.11 | | Comparative steel |
| AH | 0.20 | 0.66 | 3.14 | 0.011 | 0.0005 | 0.055 | 0.0010 | 0.0000 | 0.038 | 0.0015 | | 0.14 | | Compliant steel |
| AI | 0.20 | 0.88 | 2.69 | 0.015 | 0.0007 | 0.049 | 0.0014 | 0.0000 | 0.020 | 0.0019 | 0.086 | 0.06 | | Compliant steel |
| AJ | 0.22 | 0.92 | 3.20 | 0.006 | 0.0012 | 0.051 | 0.0029 | 0.0000 | 0.033 | 0.0026 | 0.135 | 0.12 | | Comparative steel |
| AK | 0.20 | 0.81 | 2.70 | 0.007 | 0.0013 | 0.025 | 0.0013 | 0.0000 | 0.015 | 0.0022 | 0.019 | | | Compliant steel |
| AL | 0.22 | 0.98 | 2.70 | 0.005 | 0.0011 | 0.041 | 0.0012 | 0.0000 | 0.026 | 0.0016 | 0.020 | 0.96 | | Compliant steel |
| AM | 0.23 | 0.88 | 2.78 | 0.008 | 0.0011 | 0.044 | 0.0061 | 0.0000 | 0.030 | 0.0023 | 0.013 | 1.02 | | Comparative steel |
| AN | 0.22 | 0.94 | 2.86 | 0.011 | 0.0008 | 0.011 | 0.0052 | 0.0000 | | | | | Cr: 0.340 | Compliant steel |
| AO | 0.23 | 0.92 | 2.88 | 0.006 | 0.0010 | 0.053 | 0.0063 | 0.0000 | | | | | V: 0.056 | Compliant steel |
| AP | 0.23 | 0.63 | 2.74 | 0.006 | 0.0015 | 0.014 | 0.0059 | 0.0000 | | | | | Mo: 0.330 | Compliant steel |
| AQ | 0.21 | 0.88 | 2.68 | 0.010 | 0.0008 | 0.053 | 0.0052 | 0.0000 | | | | | Ni0.10 | Compliant steel |
| AR | 0.22 | 0.83 | 2.75 | 0.007 | 0.0010 | 0.056 | 0.0051 | 0.0000 | | | | | As: 0.006 | Compliant steel |
| AS | 0.20 | 0.61 | 2.68 | 0.008 | 0.0012 | 0.017 | 0.0016 | 0.0000 | | | | | Sb: 0.011 | Compliant steel |
| AT | 0.24 | 0.80 | 2.79 | 0.014 | 0.0013 | 0.054 | 0.0016 | 0.0000 | | | | | Sn: 0.009 | Compliant steel |

TABLE 1-2-continued

| Steels | Chemical composition (mass %) | | | | | | | | | | | | | Remarks |
|---|---|---|---|---|---|---|---|---|---|---|---|---|---|---|
| | C | Si | Mn | P | S | Al | N | H | Ti | B | Nb | Cu | Others | |
| AU | 0.21 | 0.97 | 2.78 | 0.015 | 0.0008 | 0.045 | 0.0019 | 0.0000 | | | | | Ta: 0.004 | Compliant steel |
| AV | 0.24 | 0.82 | 3.14 | 0.007 | 0.0010 | 0.023 | 0.0014 | 0.0000 | | | | | Ca: 0.0014, Mg: 0.0150, Zn: 0.006, Co: 0.013 | Compliant steel |
| AW | 0.22 | 0.79 | 3.14 | 0.006 | 0.0013 | 0.056 | 0.0058 | 0.0000 | | | | | Zr: 0.002 | Compliant steel |
| AX | 0.22 | 0.83 | 3.15 | 0.013 | 0.0008 | 0.024 | 0.0063 | 0.0000 | 0.016 | 0.0023 | 0.013 | 0.16 | REM: 0.0150 | Compliant steel |
| AY | 0.22 | 0.99 | 2.96 | 0.014 | 0.0005 | 0.046 | 0.0017 | 0.0000 | | | | | | Compliant steel |
| AZ | 0.23 | 0.88 | 3.14 | 0.011 | 0.0005 | 0.018 | 0.0062 | 0.0000 | | | | | | Compliant steel |

Underlines indicate being outside of the range of the present invention.
Blanks indicate that the element was not added intentionally.

TABLE 2-1

| No. | Steels | Sheet thickness (mm) | Annealing temp. T1 (° C.) | Holding time t1 (sec) | Finish cooling temp. T2 (° C.) | Reheating temp. T3 (° C.) | Holding time t3 at reheating temp. T3 (sec) | Elapsed time t4 from when the temp. reached 100° C. until start of working (sec) |
|---|---|---|---|---|---|---|---|---|
| 1 | A | 1.4 | 871 | 176 | 188 | 397 | 225.8 | 604 |
| 2 | B | 1.4 | 870 | 151 | 194 | 371 | 129.2 | 653 |
| 3 | B | 1.4 | 855 | 182 | 207 | 389 | 165.4 | 645 |
| 4 | B | 1.4 | 842 | 147 | 205 | 398 | 238.1 | 601 |
| 5 | B | 1.4 | 968 | 145 | 217 | 385 | 248.0 | 628 |
| 6 | B | 1.4 | 992 | 131 | 203 | 395 | 291.1 | 656 |
| 7 | B | 1.4 | 878 | 11 | 180 | 381 | 218.5 | 656 |
| 8 | B | 1.4 | 871 | 3 | 209 | 383 | 211.4 | 664 |
| 9 | B | 1.4 | 864 | 956 | 209 | 379 | 174.4 | 648 |
| 10 | B | 1.4 | 870 | 998 | 199 | 357 | 265.3 | 608 |
| 11 | B | 1.4 | 870 | 96 | 111 | 352 | 105.4 | 657 |
| 12 | B | 1.4 | 866 | 97 | 89 | 395 | 289.7 | 666 |
| 13 | B | 1.4 | 877 | 169 | 289 | 363 | 233.0 | 628 |
| 14 | B | 1.4 | 874 | 113 | 311 | 371 | 266.7 | 655 |
| 15 | B | 1.4 | 880 | 180 | 281 | 281 | 293.8 | 648 |
| 16 | B | 1.4 | 872 | 100 | 267 | 267 | 227.1 | 720 |
| 17 | B | 1.4 | 862 | 99 | 200 | 444 | 194.6 | 617 |
| 18 | B | 1.4 | 864 | 74 | 190 | 462 | 142.0 | 782 |
| 19 | B | 1.4 | 869 | 96 | 194 | 390 | 1.1 | 793 |
| 20 | B | 1.4 | 876 | 149 | 192 | 399 | 0.8 | 611 |
| 21 | B | 1.4 | 871 | 168 | 208 | 359 | 992.4 | 788 |
| 22 | B | 1.4 | 862 | 145 | 186 | 357 | 1084.5 | 636 |
| 23 | B | 1.4 | 863 | 66 | 197 | 356 | 295.7 | 22 |
| 24 | B | 1.4 | 862 | 158 | 185 | 388 | 121.7 | 638 |
| 25 | B | 1.4 | 864 | 117 | 194 | 371 | 141.7 | 986 |
| 26 | B | 1.4 | 863 | 57 | 184 | 395 | 253.6 | 1065 |
| 27 | B | 1.4 | 864 | 121 | 194 | 378 | 103.5 | 680 |
| 28 | B | 1.4 | 860 | 82 | 180 | 363 | 118.6 | 666 |
| 29 | B | 1.4 | 876 | 173 | 184 | 381 | 281.1 | 785 |
| 30 | B | 1.4 | 869 | 101 | 199 | 365 | 121.8 | 620 |
| 31 | B | 1.4 | 868 | 104 | 215 | 362 | 294.5 | 782 |
| 32 | B | 1.4 | 873 | 117 | 181 | 363 | 248.4 | 686 |
| 33 | B | 1.4 | 866 | 163 | 192 | 361 | 171.8 | 690 |
| 34 | B | 1.4 | 871 | 77 | 217 | 378 | 152.7 | 794 |
| 35 | B | 1.4 | 872 | 151 | 198 | 352 | 122.6 | 758 |

| No. | Working start temp. T4 (° C.) | Equivalent plastic strain (%) | Working operations (times) | Tempering temp. T5 (° C.) | Holding time t5 (sec) | Cooling rate θ1 from tempering temp. T3 to 80° C. (° C./sec) | Type of product (*) | Remarks |
|---|---|---|---|---|---|---|---|---|
| 1 | 33 | 0.50 | 1 | 192 | 112.4 | 32 | CR | INV. EX. |
| 2 | 25 | 0.55 | 1 | 250 | 62.0 | 34 | CR | INV. EX. |
| 3 | 43 | 0.44 | 1 | 153 | 180.1 | 26 | CR | INV. EX. |
| 4 | 44 | 0.31 | 1 | 217 | 201.0 | 50 | CR | COMP. EX. |
| 5 | 35 | 0.57 | 1 | 200 | 289.4 | 35 | CR | INV. EX. |
| 6 | 42 | 0.30 | 1 | 156 | 214.5 | 37 | CR | INV. EX. |
| 7 | 36 | 0.47 | 1 | 160 | 135.4 | 48 | CR | INV. EX. |
| 8 | 28 | 0.48 | 1 | 180 | 102.2 | 33 | CR | COMP. EX. |
| 9 | 32 | 0.47 | 1 | 243 | 167.6 | 31 | CR | INV. EX. |

TABLE 2-1-continued

| | | | | | | | | |
|---|---|---|---|---|---|---|---|---|
| 10 | 38 | 0.37 | 1 | 205 | 265.1 | 35 | CR | INV. EX. |
| 11 | 39 | 0.31 | 2 | 200 | 189.9 | 30 | CR | INV. EX. |
| 12 | 33 | 0.31 | 3 | 298 | 299.2 | 33 | CR | COMP. EX. |
| 13 | 33 | 0.42 | 4 | 186 | 263.6 | 28 | CR | INV. EX. |
| 14 | 47 | 0.58 | 5 | 191 | 170.1 | 33 | CR | COMP. EX. |
| 15 | 31 | 0.55 | 6 | 193 | 161.6 | 50 | CR | INV. EX. |
| 16 | 45 | 0.37 | 7 | 256 | 200.9 | 29 | CR | INV. EX. |
| 17 | 41 | 0.55 | 8 | 173 | 233.5 | 30 | CR | INV. EX. |
| 18 | 26 | 0.38 | 9 | 283 | 176.0 | 50 | CR | COMP. EX. |
| 19 | 47 | 0.52 | 10 | 206 | 255.4 | 27 | CR | INV. EX. |
| 20 | 31 | 0.42 | 11 | 244 | 161.8 | 49 | CR | COMP. EX. |
| 21 | 28 | 0.57 | 12 | 242 | 277.2 | 28 | CR | INV. EX. |
| 22 | 40 | 0.32 | 13 | 238 | 165.9 | 42 | CR | COMP. EX. |
| 23 | 33 | 0.53 | 1 | 245 | 136.7 | 48 | CR | INV. EX. |
| 24 | 32 | 0.42 | 2 | 190 | 187.5 | 30 | CR | INV. EX. |
| 25 | 30 | 0.44 | 1 | 261 | 274.3 | 27 | CR | INV. EX. |
| 26 | 40 | 0.45 | 1 | 250 | 212.9 | 33 | CR | COMP. EX. |
| 27 | 12 | 0.59 | 1 | 272 | 186.3 | 37 | CR | INV. EX. |
| 28 | 33 | 0.36 | 3 | 194 | 169.5 | 39 | CR | INV. EX. |
| 29 | 77 | 0.45 | 1 | 260 | 149.6 | 41 | CR | INV. EX. |
| 30 | 95 | 0.37 | 1 | 275 | 182.7 | 47 | CR | COMP. EX. |
| 31 | 41 | 0.13 | 1 | 167 | 182.0 | 35 | CR | INV. EX. |
| 32 | 31 | 0.08 | 1 | 230 | 189.4 | 45 | CR | COMP. EX. |
| 33 | 48 | 4.20 | 1 | 152 | 185.0 | 31 | CR | INV. EX. |
| 34 | 27 | 5.10 | 4 | 215 | 174.5 | 49 | CR | COMP. EX. |
| 35 | 44 | 0.47 | 1 | 106 | 163.4 | 48 | CR | INV. EX. |

Underlines indicate being outside of the range of the present invention.

(*) CR: Cold rolled steel sheet (without coating)

TABLE 2-2

| No. | Steels | Sheet thickness (mm) | Annealing temp. T1 (° C.) | Holding time t1 (sec) | Finish cooling temp. T2 (° C.) | Reheating temp. T3 (° C.) | Holding time t3 at reheating temp. T3 (sec) | Elapsed time t4 from when the temp. reached 100° C. until start of working (sec) |
|---|---|---|---|---|---|---|---|---|
| 36 | B | 1.4 | 861 | 114 | 183 | 367 | 259.8 | 633 |
| 37 | B | 0.8 | 871 | 198 | 189 | 368 | 221.8 | 764 |
| 38 | B | 2.0 | 877 | 78 | 193 | 390 | 125.5 | 752 |
| 39 | B | 1.4 | 862 | 119 | 213 | 392 | 145.2 | 725 |
| 40 | B | 1.4 | 866 | 89 | 202 | 358 | 229.3 | 695 |
| 41 | B | 1.4 | 873 | 166 | 182 | 368 | 250.7 | 690 |
| 42 | B | 1.4 | 876 | 105 | 216 | 385 | 167.9 | 789 |
| 43 | B | 1.4 | 867 | 111 | 211 | 361 | 105.4 | 695 |
| 44 | B | 1.4 | 863 | 139 | 213 | 353 | 215.3 | 621 |
| 45 | B | 1.4 | 880 | 162 | 200 | 356 | 247.7 | 778 |
| 46 | B | 1.4 | 876 | 112 | 205 | 386 | 203.6 | 667 |
| 47 | B | 1.4 | 871 | 103 | 199 | 368 | 277.5 | 717 |
| 48 | B | 1.4 | 875 | 65 | 216 | 364 | 277.0 | 757 |
| 49 | B | 1.4 | 876 | 95 | 108 | 391 | 115.0 | 638 |
| 50 | B | 1.4 | 875 | 125 | 197 | 442 | 256.8 | 795 |
| 51 | B | 1.4 | 868 | 191 | 217 | 375 | 266.0 | 996 |
| 52 | B | 1.4 | 869 | 59 | 184 | 399 | 170.8 | 646 |
| 53 | B | 1.4 | 879 | 169 | 200 | 351 | 129.2 | 793 |
| 54 | B | 1.4 | 860 | 61 | 182 | 395 | 181.0 | 632 |
| 55 | C | 1.4 | 870 | 65 | 274 | 274 | 280.9 | 667 |
| 56 | D | 1.4 | 879 | 84 | 294 | 294 | 168.3 | 681 |
| 57 | E | 1.4 | 875 | 75 | 181 | 356 | 134.4 | 726 |
| 58 | F | 1.2 | 879 | 182 | 220 | 384 | 298.1 | 776 |
| 59 | G | 1.2 | 867 | 174 | 214 | 355 | 141.1 | 602 |
| 60 | H | 1.2 | 870 | 183 | 208 | 379 | 110.6 | 641 |
| 61 | I | 1.2 | 875 | 93 | 193 | 383 | 222.8 | 782 |
| 62 | J | 1.2 | 875 | 102 | 185 | 360 | 212.3 | 747 |
| 63 | K | 1.2 | 861 | 54 | 183 | 391 | 156.6 | 773 |
| 64 | L | 1.2 | 865 | 144 | 181 | 390 | 276.9 | 763 |
| 65 | M | 1.2 | 878 | 112 | 193 | 388 | 125.4 | 705 |
| 66 | N | 1.2 | 879 | 148 | 212 | 387 | 286.5 | 620 |
| 67 | O | 1.6 | 872 | 79 | 202 | 374 | 175.8 | 754 |
| 68 | P | 1.6 | 861 | 194 | 196 | 379 | 243.0 | 690 |

TABLE 2-2-continued

| | | | | | | | | |
|---|---|---|---|---|---|---|---|---|
| 69 | Q | 1.6 | 869 | 169 | 189 | 395 | 176.9 | 769 |
| 70 | R | 1.6 | 872 | 104 | 204 | 373 | 158.4 | 699 |

| No. | Working start temp. T4 (° C.) | Equivalent plastic strain (%) | Working operations (times) | Tempering temp. T5 (° C.) | Holding time t5 (sec) | Cooling rate θ1 from tempering temp. T3 to 80° C. (° C./sec) | Type of product (*) | Remarks |
|---|---|---|---|---|---|---|---|---|
| 36 | 43 | 0.53 | 1 | 90 | 299.3 | 41 | CR | COMP. EX. |
| 37 | 46 | 0.36 | 1 | 391 | 197.3 | 44 | CR | INV. EX. |
| 38 | 45 | 0.31 | 1 | 393 | 106.3 | 48 | CR | INV. EX. |
| 39 | 44 | 0.46 | 1 | 202 | 4.7 | 47 | CR | INV. EX. |
| 40 | 27 | 0.37 | 1 | 222 | 2.2 | 33 | CR | INV. EX. |
| 41 | 43 | 0.36 | 1 | 164 | 1.2 | 35 | CR | INV. EX. |
| 42 | 40 | 0.57 | 1 | 298 | 0.8 | 39 | CR | COMP. EX. |
| 43 | 38 | 0.51 | 1 | 204 | 988.0 | 39 | CR | INV. EX. |
| 44 | 30 | 0.59 | 1 | 267 | 992.1 | 39 | CR | INV. EX. |
| 45 | 42 | 0.47 | 1 | 266 | 200.5 | 5 | CR | INV. EX. |
| 46 | 49 | 0.30 | 4 | 285 | 219.7 | 40 | CR | INV. EX. |
| 47 | 34 | 0.57 | 1 | 287 | 244.9 | 98 | CR | INV. EX. |
| 48 | 47 | 0.52 | 1 | 290 | 295.6 | 125 | CR | COMP. EX. |
| 49 | 46 | 0.31 | 1 | 185 | 271.0 | 34 | CR | INV. EX. |
| 50 | 43 | 0.43 | 1 | 168 | 199.0 | 45 | CR | INV. EX. |
| 51 | 47 | 0.53 | 1 | 229 | 170.0 | 38 | CR | INV. EX. |
| 52 | 31 | 0.13 | 1 | 197 | 169.9 | 31 | CR | INV. EX. |
| 53 | 45 | 0.33 | 1 | 105 | 174.4 | 41 | CR | INV. EX. |
| 54 | 48 | 0.39 | 1 | 381 | 210.5 | 28 | CR | INV. EX. |
| 55 | 34 | 0.33 | 4 | 157 | 147.6 | 43 | CR | INV. EX. |
| 56 | 44 | 0.46 | 4 | 264 | 140.9 | 28 | CR | INV. EX. |
| 57 | 44 | 0.52 | 4 | 235 | 144.1 | 26 | CR | INV. EX. |
| 58 | 36 | 0.35 | 1 | 234 | 224.9 | 26 | CR | INV. EX. |
| 59 | 31 | 0.30 | 1 | 176 | 294.4 | 30 | GA | COMP. EX. |
| 60 | 30 | 0.32 | 1 | 199 | 298.2 | 27 | GA | INV. EX. |
| 61 | 41 | 0.49 | 1 | 209 | 231.9 | 37 | GA | COMP. EX. |
| 62 | 48 | 0.39 | 1 | 258 | 232.8 | 48 | GA | INV. EX. |
| 63 | 31 | 0.55 | 1 | 175 | 227.1 | 31 | GA | COMP. EX. |
| 64 | 44 | 0.35 | 1 | 173 | 120.6 | 48 | CR | INV. EX. |
| 65 | 40 | 0.59 | 1 | 246 | 102.6 | 26 | CR | COMP. EX. |
| 66 | 33 | 0.43 | 1 | 208 | 201.8 | 32 | GA | INV. EX. |
| 67 | 31 | 0.30 | 1 | 298 | 148.0 | 32 | GA | COMP. EX. |
| 68 | 26 | 0.39 | 1 | 276 | 114.1 | 36 | GI | INV. EX. |
| 69 | 45 | 0.42 | 1 | 244 | 148.4 | 30 | GA | COMP. EX. |
| 70 | 42 | 0.55 | 1 | 228 | 295.2 | 34 | GA | INV. EX. |

Underlines indicate being outside of the range of the present invention.

(*) CR: Cold rolled steel sheet (without coating), GI: Hot-dip galvanized steel sheet (without alloying treatment), GA: Galvannealed steel sheet

TABLE 2-3

| No. | Steels | Sheet thickness (mm) | Annealing temp. T1 (° C.) | Holding time t1 (sec) | Finish cooling temp. T2 (° C.) | Reheating temp. T3 (° C.) | Holding time t3 at reheating temp. T3 (sec) | Elapsed time t4 from when the temp. reached 100° C. until start of working (sec) |
|---|---|---|---|---|---|---|---|---|
| 71 | S | 1.6 | 868 | 170 | 188 | 391 | 183.8 | 725 |
| 72 | T | 1.6 | 879 | 102 | 189 | 361 | 136.0 | 676 |
| 73 | U | 1.6 | 866 | 140 | 189 | 380 | 295.9 | 686 |
| 74 | V | 1.6 | 877 | 184 | 184 | 372 | 268.7 | 798 |
| 75 | W | 1.4 | 873 | 199 | 214 | 383 | 203.8 | 601 |
| 76 | X | 1.4 | 871 | 52 | 188 | 390 | 249.0 | 649 |
| 77 | Y | The slab fractured during casting and the test was discontinued. | | | | | | |
| 78 | Z | 1.4 | 873 | 126 | 200 | 360 | 273.8 | 678 |
| 79 | AA | 1.4 | 865 | 130 | 202 | 375 | 254.7 | 692 |
| 80 | AB | 1.4 | 864 | 170 | 180 | 370 | 172.0 | 779 |
| 81 | AC | 1.4 | 877 | 89 | 196 | 395 | 117.5 | 672 |
| 82 | AD | The slab fractured during casting and the test was discontinued. | | | | | | |
| 83 | AE | 1.4 | 866 | 143 | 184 | 382 | 262.5 | 613 |
| 84 | AF | 1.4 | 874 | 117 | 186 | 356 | 109.6 | 745 |
| 85 | AG | The slab fractured during casting and the test was discontinued. | | | | | | |
| 86 | AH | 1.4 | 879 | 146 | 215 | 365 | 104.8 | 751 |
| 87 | AI | 1.4 | 863 | 189 | 186 | 369 | 144.3 | 792 |
| 88 | AJ | The slab fractured during casting and the test was discontinued. | | | | | | |

TABLE 2-3-continued

| | | | | | | | | |
|---|---|---|---|---|---|---|---|---|
| 89 | AK | 1.4 | 878 | 64 | 216 | 363 | 144.3 | 684 |
| 90 | AL | 1.4 | 875 | 184 | 199 | 353 | 291.0 | 745 |
| 91 | AM | The slab fractured during casting and the test was discontinued. | | | | | | |
| 92 | AN | 1.4 | 864 | 131 | 205 | 397 | 250.7 | 752 |
| 93 | AO | 1.4 | 873 | 197 | 196 | 392 | 160.8 | 701 |
| 94 | AP | 1.4 | 865 | 197 | 184 | 359 | 208.4 | 628 |
| 95 | AQ | 1.4 | 862 | 171 | 187 | 359 | 147.2 | 673 |
| 96 | AR | 1.4 | 871 | 194 | 183 | 361 | 191.9 | 632 |
| 97 | AS | 1.4 | 865 | 193 | 189 | 355 | 233.7 | 663 |
| 98 | AT | 1.4 | 880 | 168 | 208 | 382 | 272.0 | 643 |
| 99 | AU | 1.4 | 860 | 75 | 192 | 375 | 124.1 | 648 |
| 100 | AV | 1.4 | 878 | 98 | 216 | 352 | 247.0 | 639 |
| 101 | AW | 1.4 | 872 | 85 | 185 | 377 | 270.4 | 667 |
| 102 | AX | 1.4 | 869 | 179 | 190 | 397 | 284.4 | 628 |
| 103 | AY | 0.8 | 861 | 91 | 197 | 369 | 191.9 | 682 |
| 104 | AZ | 2.0 | 864 | 151 | 202 | 367 | 287.5 | 674 |

| No. | Working start temp. T4 (° C.) | Equivalent plastic strain (%) | Working operations (times) | Tempering temp. T5 (° C.) | Holding time t5 (sec) | Cooling rate θ1 from tempering temp. T3 to 80° C. (° C./sec) | Type of product (*) | Remarks |
|---|---|---|---|---|---|---|---|---|
| 71 | 43 | 0.55 | 1 | 206 | 181.2 | 37 | GA | COMP. EX. |
| 72 | 50 | 0.47 | 1 | 261 | 193.0 | 47 | GA | INV. EX. |
| 73 | 48 | 0.49 | 1 | 165 | 179.4 | 29 | GI | COMP. EX. |
| 74 | 27 | 0.41 | 3 | 154 | 221.0 | 39 | GA | INV. EX. |
| 75 | 41 | 0.41 | 1 | 241 | 165.1 | 33 | GA | COMP. EX. |
| 76 | 44 | 0.56 | 1 | 163 | 195.7 | 31 | GA | INV. EX. |
| 77 | The slab fractured during casting and the test was discontinued. | | | | | | | COMP. EX. |
| 78 | 26 | 0.54 | 1 | 217 | 163.5 | 30 | GA | INV. EX. |
| 79 | 34 | 0.53 | 1 | 223 | 176.5 | 35 | GI | COMP. EX. |
| 80 | 27 | 0.54 | 1 | 295 | 196.7 | 28 | GA | INV. EX. |
| 81 | 31 | 0.31 | 1 | 258 | 211.0 | 31 | GA | INV. EX. |
| 82 | The slab fractured during casting and the test was discontinued. | | | | | | | COMP. EX. |
| 83 | 43 | 0.54 | 1 | 292 | 130.6 | 31 | GA | INV. EX. |
| 84 | 37 | 0.58 | 1 | 202 | 268.9 | 37 | CR | INV. EX. |
| 85 | The slab fractured during casting and the test was discontinued. | | | | | | | COMP. EX. |
| 86 | 42 | 0.53 | 2 | 171 | 121.3 | 35 | GA | INV. EX. |
| 87 | 31 | 0.30 | 1 | 170 | 268.2 | 40 | GA | INV. EX. |
| 88 | The slab fractured during casting and the test was discontinued. | | | | | | | COMP. EX. |
| 89 | 45 | 0.33 | 1 | 273 | 219.2 | 47 | GA | INV. EX. |
| 90 | 43 | 0.38 | 1 | 211 | 141.6 | 26 | GA | INV. EX. |
| 91 | The slab fractured during casting and the test was discontinued. | | | | | | | COMP. EX. |
| 92 | 37 | 0.41 | 1 | 251 | 184.8 | 49 | GA | INV. EX. |
| 93 | 25 | 0.44 | 1 | 230 | 276.8 | 49 | CR | INV. EX. |
| 94 | 45 | 0.32 | 1 | 215 | 158.5 | 41 | CR | INV. EX. |
| 95 | 29 | 0.54 | 1 | 230 | 181.6 | 43 | CR | INV. EX. |
| 96 | 40 | 0.47 | 4 | 159 | 188.3 | 39 | CR | INV. EX. |
| 97 | 26 | 0.57 | 1 | 155 | 160.8 | 48 | CR | INV. EX. |
| 98 | 32 | 0.51 | 1 | 220 | 226.6 | 29 | CR | INV. EX. |
| 99 | 43 | 0.48 | 4 | 221 | 270.1 | 41 | CR | INV. EX. |
| 100 | 49 | 0.60 | 1 | 273 | 137.9 | 47 | CR | INV. EX. |
| 101 | 49 | 0.43 | 1 | 178 | 199.2 | 44 | CR | INV. EX. |
| 102 | 37 | 0.51 | 1 | 176 | 292.4 | 41 | CR | INV. EX. |
| 103 | 38 | 0.45 | 1 | 172 | 274.7 | 28 | EG | INV. EX. |
| 104 | 48 | 0.36 | 1 | 166 | 226.4 | 39 | EG | INV. EX. |

Underlines indicate being outside of the range of the present invention.

(*) CR: Cold rolled steel sheet (without coating), GI: Hot-dip galvanized steel sheet (without alloying treatment), GA: Galvannealed steel sheet, EG: Electrogalvanized steel sheet

TABLE 3-1

| No. | Steels | Sheet thickness (mm) | Tempered martensite (%) | Retained austenite (%) | Total of ferrite and bainitic ferrite (%) | Carbon concentration in retained austenite (%) | KAM(S) (°) | KAM(C) (°) | KAM(S)/KAM(C) |
|---|---|---|---|---|---|---|---|---|---|
| 1 | A | 1.4 | 91 | 9 | 0 | 0.80 | 0.500 | 0.535 | 0.935 |
| 2 | B | 1.4 | 92 | 8 | 0 | 0.80 | 0.500 | 0.539 | 0.928 |
| 3 | B | 1.4 | 80 | 10 | 10 | 0.80 | 0.509 | 0.539 | 0.944 |
| 4 | B | 1.4 | 79 | 10 | 12 | 0.60 | 0.515 | 0.538 | 0.957 |
| 5 | B | 1.4 | 89 | 11 | 0 | 1.00 | 0.506 | 0.538 | 0.941 |
| 6 | B | 1.4 | 91 | 9 | 0 | 0.60 | 0.514 | 0.541 | 0.951 |
| 7 | B | 1.4 | 84 | 7 | 9 | 0.70 | 0.506 | 0.532 | 0.951 |
| 8 | B | 1.4 | 77 | 10 | 13 | 0.80 | 0.510 | 0.539 | 0.945 |
| 9 | B | 1.4 | 90 | 10 | 0 | 0.80 | 0.503 | 0.535 | 0.941 |
| 10 | B | 1.4 | 91 | 9 | 0 | 0.70 | 0.514 | 0.538 | 0.956 |

TABLE 3-1-continued

| | | | | | | | | | |
|---|---|---|---|---|---|---|---|---|---|
| 11 | B | 1.4 | 94 | 6 | 0 | 1.00 | 0.512 | 0.535 | 0.957 |
| 12 | B | 1.4 | 98 | 2 | 0 | 1.10 | 0.514 | 0.536 | 0.960 |
| 13 | B | 1.4 | 86 | 14 | 0 | 0.60 | 0.512 | 0.536 | 0.955 |
| 14 | B | 1.4 | 83 | 17 | 0 | 0.60 | 0.502 | 0.539 | 0.931 |
| 15 | B | 1.4 | 86 | 14 | 0 | 1.10 | 0.503 | 0.533 | 0.945 |
| 16 | B | 1.4 | 85 | 15 | 0 | 1.00 | 0.512 | 0.534 | 0.958 |
| 17 | B | 1.4 | 81 | 9 | 10 | 0.90 | 0.506 | 0.535 | 0.945 |
| 18 | B | 1.4 | 79 | 8 | 13 | 0.60 | 0.509 | 0.533 | 0.955 |
| 19 | B | 1.4 | 94 | 6 | 0 | 0.70 | 0.496 | 0.533 | 0.931 |
| 20 | B | 1.4 | 96 | 4 | 0 | 0.50 | 0.502 | 0.534 | 0.939 |
| 21 | B | 1.4 | 82 | 10 | 8 | 0.90 | 0.502 | 0.537 | 0.935 |
| 22 | B | 1.4 | 79 | 8 | 14 | 0.60 | 0.510 | 0.534 | 0.955 |
| 23 | B | 1.4 | 91 | 9 | 0 | 0.80 | 0.504 | 0.538 | 0.936 |
| 24 | B | 1.4 | 93 | 8 | 0 | 0.60 | 0.516 | 0.540 | 0.956 |
| 25 | B | 1.4 | 92 | 8 | 0 | 0.70 | 0.525 | 0.533 | 0.984 |
| 26 | B | 1.4 | 93 | 7 | 0 | 0.70 | 0.543 | 0.541 | 1.004 |
| 27 | B | 1.4 | 92 | 8 | 0 | 0.90 | 0.503 | 0.538 | 0.935 |
| 28 | B | 1.4 | 93 | 7 | 0 | 0.60 | 0.513 | 0.536 | 0.957 |
| 29 | B | 1.4 | 93 | 7 | 0 | 0.70 | 0.529 | 0.537 | 0.987 |
| 30 | B | 1.4 | 91 | 9 | 0 | 0.70 | 0.541 | 0.536 | 1.010 |
| 31 | B | 1.4 | 90 | 11 | 0 | 0.50 | 0.533 | 0.541 | 0.987 |
| 32 | B | 1.4 | 93 | 7 | 0 | 0.30 | 0.533 | 0.533 | 1.000 |
| 33 | B | 1.4 | 94 | 6 | 0 | 1.00 | 0.502 | 0.534 | 0.940 |
| 34 | B | 1.4 | 98 | 2 | 0 | 1.20 | 0.495 | 0.534 | 0.927 |
| 35 | B | 1.4 | 91 | 9 | 0 | 0.80 | 0.507 | 0.537 | 0.945 |

| No. | Hv(Q) | Hv(S) | Hv(Q) − Hv(S) | TS (MPa) | EI (%) | Range of appropriate clearances for hole expanding deformation | Range of appropriate clearances not leading to delayed fracture | Remarks |
|---|---|---|---|---|---|---|---|---|
| 1 | 526 | 511 | 15 | 1600 | 10 | ◎ | ◎ | INV. EX. |
| 2 | 511 | 494 | 17 | 1546 | 10 | ◎ | ◎ | INV. EX. |
| 3 | 458 | 446 | 12 | 1395 | 13 | ○ | ◎ | INV. EX. |
| 4 | 429 | 413 | 16 | 1294 | 14 | X | ◎ | COMP. EX. |
| 5 | 519 | 502 | 17 | 1571 | 12 | ◎ | ○ | INV. EX. |
| 6 | 521 | 509 | 12 | 1593 | 10 | ◎ | ○ | INV. EX. |
| 7 | 452 | 440 | 12 | 1378 | 11 | ○ | ◎ | INV. EX. |
| 8 | 423 | 410 | 13 | 1284 | 14 | X | ◎ | COMP. EX. |
| 9 | 514 | 495 | 19 | 1550 | 11 | ◎ | ○ | INV. EX. |
| 10 | 517 | 501 | 16 | 1569 | 11 | ◎ | ○ | INV. EX. |
| 11 | 516 | 502 | 14 | 1571 | 9 | ◎ | ◎ | INV. EX. |
| 12 | 509 | 486 | 23 | 1522 | 6 | ◎ | ◎ | COMP. EX. |
| 13 | 519 | 504 | 15 | 1578 | 14 | ○ | ◎ | INV. EX. |
| 14 | 520 | 504 | 16 | 1576 | 16 | X | ◎ | COMP. EX. |
| 15 | 518 | 503 | 15 | 1575 | 14 | ◎ | ◎ | INV. EX. |
| 16 | 511 | 493 | 18 | 1543 | 15 | ◎ | ◎ | INV. EX. |
| 17 | 446 | 432 | 14 | 1353 | 12 | ○ | ◎ | INV. EX. |
| 18 | 431 | 411 | 20 | 1285 | 12 | X | ◎ | COMP. EX. |
| 19 | 519 | 501 | 18 | 1568 | 9 | ◎ | ◎ | INV. EX. |
| 20 | 514 | 495 | 19 | 1549 | 7 | ◎ | ◎ | COMP. EX. |
| 21 | 458 | 438 | 20 | 1370 | 13 | ○ | ◎ | INV. EX. |
| 22 | 430 | 413 | 17 | 1294 | 12 | X | ◎ | COMP. EX. |
| 23 | 513 | 495 | 18 | 1549 | 11 | ◎ | ◎ | INV. EX. |
| 24 | 517 | 504 | 13 | 1576 | 10 | ◎ | ◎ | INV. EX. |
| 25 | 501 | 492 | 9 | 1541 | 10 | ○ | ○ | INV. EX. |
| 26 | 496 | 494 | 2 | 1546 | 9 | X | X | COMP. EX. |
| 27 | 512 | 490 | 22 | 1535 | 10 | ◎ | ◎ | INV. EX. |
| 28 | 517 | 503 | 14 | 1574 | 9 | ◎ | ◎ | INV. EX. |
| 29 | 502 | 492 | 10 | 1541 | 9 | ○ | ○ | INV. EX. |
| 30 | 496 | 490 | 6 | 1534 | 11 | X | X | COMP. EX. |
| 31 | 516 | 507 | 9 | 1588 | 12 | ○ | ○ | INV. EX. |
| 32 | 502 | 497 | 5 | 1556 | 9 | X | X | COMP. EX. |
| 33 | 522 | 510 | 12 | 1595 | 8 | ◎ | ◎ | INV. EX. |
| 34 | 518 | 500 | 18 | 1564 | 6 | ◎ | ◎ | COMP. EX. |
| 35 | 556 | 547 | 9 | 1711 | 10 | ○ | ○ | INV. EX. |

Underlines indicate being outside of the range of the present invention.

TABLE 3-2

| No. | Steels | Sheet thickness (mm) | Tempered martensite (%) | Retained austenite (%) | Total of ferrite and bainitic ferrite (%) | Carbon concentration in retained austenite (%) | KAM(S) (°) | KAM(C) (°) | KAM(S)/KAM(C) |
|---|---|---|---|---|---|---|---|---|---|
| 36 | B | 1.4 | 93 | 7 | 0 | 0.70 | 0.503 | 0.535 | 0.941 |
| 37 | B | 0.8 | 92 | 8 | 0 | 0.60 | 0.514 | 0.535 | 0.960 |
| 38 | B | 2.0 | 92 | 8 | 0 | 0.60 | 0.510 | 0.533 | 0.957 |
| 39 | B | 1.4 | 90 | 10 | 0 | 0.80 | 0.506 | 0.533 | 0.949 |

TABLE 3-2-continued

| | | | | | | | | | |
|---|---|---|---|---|---|---|---|---|---|
| 40 | B | 1.4 | 91 | 9 | 0 | 0.70 | 0.511 | 0.533 | 0.958 |
| 41 | B | 1.4 | 93 | 7 | 0 | 0.60 | 0.512 | 0.534 | 0.958 |
| 42 | B | 1.4 | 89 | 11 | 0 | 1.00 | 0.506 | 0.537 | 0.941 |
| 43 | B | 1.4 | 90 | 10 | 0 | 0.90 | 0.495 | 0.533 | 0.928 |
| 44 | B | 1.4 | 90 | 10 | 0 | 1.00 | 0.501 | 0.535 | 0.936 |
| 45 | B | 1.4 | 91 | 9 | 0 | 0.80 | 0.503 | 0.533 | 0.943 |
| 46 | B | 1.4 | 91 | 10 | 0 | 0.60 | 0.514 | 0.539 | 0.954 |
| 47 | B | 1.4 | 91 | 9 | 0 | 0.90 | 0.508 | 0.540 | 0.941 |
| 48 | B | 1.4 | 89 | 11 | 0 | 0.90 | 0.507 | 0.537 | 0.944 |
| 49 | B | 1.4 | 94 | 6 | 0 | 0.50 | 0.520 | 0.540 | 0.963 |
| 50 | B | 1.4 | 83 | 9 | 8 | 0.70 | 0.510 | 0.534 | 0.954 |
| 51 | B | 1.4 | 89 | 11 | 0 | 0.90 | 0.525 | 0.536 | 0.984 |
| 52 | B | 1.4 | 93 | 7 | 0 | 0.60 | 0.534 | 0.540 | 0.980 |
| 53 | B | 1.4 | 91 | 9 | 0 | 0.60 | 0.518 | 0.536 | 0.966 |
| 54 | B | 1.4 | 93 | 7 | 0 | 0.60 | 0.513 | 0.538 | 0.953 |
| 55 | C | 1.4 | 87 | 13 | 0 | 0.80 | 0.514 | 0.541 | 0.951 |
| 56 | D | 1.4 | 85 | 15 | 0 | 1.10 | 0.502 | 0.537 | 0.935 |
| 57 | E | 1.4 | 93 | 7 | 0 | 0.70 | 0.510 | 0.538 | 0.948 |
| 58 | F | 1.2 | 88 | 12 | 0 | 0.80 | 0.513 | 0.536 | 0.957 |
| 59 | G | 1.2 | 89 | 11 | 0 | 0.70 | 0.513 | 0.532 | 0.964 |
| 60 | H | 1.2 | 89 | 11 | 0 | 0.70 | 0.510 | 0.536 | 0.953 |
| 61 | I | 1.2 | 92 | 8 | 0 | 0.80 | 0.511 | 0.539 | 0.948 |
| 62 | J | 1.2 | 94 | 6 | 0 | 0.50 | 0.515 | 0.540 | 0.954 |
| 63 | K | 1.2 | 97 | 3 | 0 | 0.30 | 0.502 | 0.537 | 0.936 |
| 64 | L | 1.2 | 94 | 6 | 0 | 1.00 | 0.510 | 0.536 | 0.951 |
| 65 | M | 1.2 | 93 | 7 | 0 | 1.10 | 0.503 | 0.537 | 0.938 |
| 66 | N | 1.2 | 81 | 10 | 9 | 0.80 | 0.510 | 0.537 | 0.950 |
| 67 | O | 1.6 | 76 | 10 | 14 | 0.60 | 0.518 | 0.537 | 0.964 |
| 68 | P | 1.6 | 91 | 9 | 0 | 0.70 | 0.511 | 0.535 | 0.955 |
| 69 | Q | 1.6 | 92 | 8 | 0 | 0.70 | 0.506 | 0.537 | 0.941 |
| 70 | R | 1.6 | 90 | 10 | 0 | 0.90 | 0.506 | 0.539 | 0.938 |

| No. | Hv(Q) | Hv(S) | Hv(Q) − Hv(S) | TS (MPa) | EI (%) | Range of appropriate clearances for hole expanding deformation | Range of appropriate clearances not leading to delayed fracture | Remarks |
|---|---|---|---|---|---|---|---|---|
| 36 | 584 | 583 | 1 | 1825 | 9 | X | X | COMP. EX. |
| 37 | 499 | 472 | 27 | 1476 | 11 | ◎ | ◎ | INV. EX. |
| 38 | 439 | 413 | 26 | 1470 | 12 | ◎ | ◎ | INV. EX. |
| 39 | 511 | 502 | 9 | 1570 | 11 | ○ | ○ | INV. EX. |
| 40 | 508 | 498 | 10 | 1560 | 11 | ○ | ○ | INV. EX. |
| 41 | 516 | 508 | 8 | 1589 | 9 | ○ | ○ | INV. EX. |
| 42 | 484 | 486 | −2 | 1522 | 12 | X | X | COMP. EX. |
| 43 | 523 | 501 | 22 | 1569 | 11 | ◎ | ◎ | INV. EX. |
| 44 | 442 | 415 | 27 | 1482 | 13 | ◎ | ◎ | INV. EX. |
| 45 | 512 | 491 | 21 | 1538 | 11 | ◎ | ◎ | INV. EX. |
| 46 | 510 | 488 | 22 | 1529 | 11 | ◎ | ◎ | INV. EX. |
| 47 | 511 | 488 | 23 | 1528 | 11 | ○ | ○ | INV. EX. |
| 48 | 492 | 488 | 4 | 1526 | 12 | X | X | COMP. EX. |
| 49 | 518 | 504 | 14 | 1579 | 9 | ◎ | ◎ | INV. EX. |
| 50 | 449 | 436 | 13 | 1365 | 12 | ○ | ◎ | INV. EX. |
| 51 | 506 | 497 | 9 | 1557 | 12 | ○ | ○ | INV. EX. |
| 52 | 512 | 503 | 9 | 1573 | 9 | ○ | ○ | INV. EX. |
| 53 | 526 | 517 | 9 | 1619 | 10 | ○ | ○ | INV. EX. |
| 54 | 466 | 438 | 28 | 1372 | 11 | ◎ | ◎ | INV. EX. |
| 55 | 526 | 515 | 11 | 1611 | 13 | ◎ | ◎ | INV. EX. |
| 56 | 520 | 500 | 20 | 1564 | 14 | ◎ | ◎ | INV. EX. |
| 57 | 517 | 500 | 17 | 1565 | 9 | ◎ | ◎ | INV. EX. |
| 58 | 451 | 434 | 17 | 1357 | 14 | ◎ | ◎ | INV. EX. |
| 59 | 425 | 412 | 13 | 1290 | 14 | ◎ | ◎ | COMP. EX. |
| 60 | 594 | 578 | 16 | 1810 | 9 | ◎ | ◎ | INV. EX. |
| 61 | 609 | 593 | 16 | 1856 | 7 | ◎ | ◎ | COMP. EX. |
| 62 | 518 | 499 | 19 | 1562 | 9 | ○ | ◎ | INV. EX. |
| 63 | 515 | 500 | 15 | 1565 | 7 | X | ◎ | COMP. EX. |
| 64 | 516 | 504 | 12 | 1578 | 9 | ◎ | ○ | INV. EX. |
| 65 | 524 | 506 | 18 | 1584 | 9 | ◎ | X | COMP. EX. |
| 66 | 440 | 425 | 15 | 1329 | 13 | ○ | ◎ | INV. EX. |
| 67 | 433 | 414 | 19 | 1296 | 14 | X | ◎ | COMP. EX. |
| 68 | 533 | 515 | 18 | 1612 | 10 | ◎ | ○ | INV. EX. |
| 69 | 539 | 521 | 18 | 1630 | 10 | ◎ | X | COMP. EX. |
| 70 | 523 | 504 | 19 | 1576 | 11 | ◎ | ○ | INV. EX. |

Underlines indicate being outside of the range of the present invention.

TABLE 3-3

| No. | Steels | Sheet thickness (mm) | Tempered martensite (%) | Retained austenite (%) | Total of ferrite and bainitic ferrite (%) | Carbon concentration in retained austenite (%) | KAM(S) (°) | KAM(C) (°) | KAM(S)/KAM(C) |
|---|---|---|---|---|---|---|---|---|---|
| 71 | S | 1.6 | 91 | 9 | 0 | 0.80 | 0.502 | 0.537 | 0.936 |
| 72 | T | 1.6 | 91 | 9 | 0 | 0.80 | 0.505 | 0.533 | 0.946 |
| 73 | U | 1.6 | 92 | 8 | 0 | 0.80 | 0.499 | 0.533 | 0.936 |
| 74 | V | 1.6 | 82 | 8 | 9 | 0.70 | 0.512 | 0.538 | 0.951 |
| 75 | W | 1.4 | 77 | 12 | 11 | 0.80 | 0.502 | 0.532 | 0.943 |
| 76 | X | 1.4 | 92 | 8 | 0 | 0.80 | 0.496 | 0.537 | 0.924 |
| 77 | Y | The slab fractured during casting and the test was discontinued. | | | | | | | |
| 78 | Z | 1.4 | 90 | 10 | 0 | 0.90 | 0.506 | 0.537 | 0.944 |
| 79 | AA | 1.4 | 90 | 10 | 0 | 0.90 | 0.506 | 0.537 | 0.944 |
| 80 | AB | 1.4 | 93 | 7 | 0 | 0.70 | 0.499 | 0.536 | 0.932 |
| 81 | AC | 1.4 | 91 | 9 | 0 | 0.60 | 0.518 | 0.537 | 0.966 |
| 82 | AD | The slab fractured during casting and the test was discontinued. | | | | | | | |
| 83 | AE | 1.4 | 91 | 9 | 0 | 0.80 | 0.502 | 0.537 | 0.935 |
| 84 | AF | 1.4 | 91 | 9 | 0 | 0.90 | 0.498 | 0.538 | 0.926 |
| 85 | AG | The slab fractured during casting and the test was discontinued. | | | | | | | |
| 86 | AH | 1.4 | 89 | 11 | 0 | 0.90 | 0.499 | 0.533 | 0.936 |
| 87 | AI | 1.4 | 91 | 9 | 0 | 0.60 | 0.523 | 0.541 | 0.968 |
| 88 | AJ | The slab fractured during casting and the test was discontinued. | | | | | | | |
| 89 | AK | 1.4 | 89 | 11 | 0 | 0.70 | 0.511 | 0.537 | 0.953 |
| 90 | AL | 1.4 | 90 | 10 | 0 | 0.70 | 0.511 | 0.533 | 0.958 |
| 91 | AM | The slab fractured during casting and the test was discontinued. | | | | | | | |
| 92 | AN | 1.4 | 89 | 11 | 0 | 0.80 | 0.506 | 0.538 | 0.939 |
| 93 | AO | 1.4 | 90 | 10 | 0 | 0.80 | 0.510 | 0.533 | 0.955 |
| 94 | AP | 1.4 | 93 | 7 | 0 | 0.50 | 0.512 | 0.534 | 0.958 |
| 95 | AQ | 1.4 | 91 | 9 | 0 | 0.80 | 0.500 | 0.533 | 0.937 |
| 96 | AR | 1.4 | 92 | 8 | 0 | 0.70 | 0.514 | 0.541 | 0.950 |
| 97 | AS | 1.4 | 92 | 8 | 0 | 0.80 | 0.504 | 0.540 | 0.934 |
| 98 | AT | 1.4 | 89 | 11 | 0 | 0.90 | 0.508 | 0.541 | 0.940 |
| 99 | AU | 1.4 | 90 | 10 | 0 | 0.80 | 0.506 | 0.533 | 0.948 |
| 100 | AV | 1.4 | 89 | 11 | 0 | 1.00 | 0.494 | 0.535 | 0.924 |
| 101 | AW | 1.4 | 92 | 8 | 0 | 0.70 | 0.507 | 0.535 | 0.948 |
| 102 | AX | 1.4 | 91 | 9 | 0 | 0.80 | 0.499 | 0.536 | 0.932 |
| 103 | AY | 0.8 | 90 | 10 | 0 | 0.80 | 0.503 | 0.536 | 0.939 |
| 104 | AZ | 2.0 | 90 | 10 | 0 | 0.70 | 0.507 | 0.533 | 0.951 |

| No. | Hv(Q) | Hv(S) | Hv(Q) − Hv(S) | TS (MPa) | EI (%) | Range of appropriate clearances for hole expanding deformation | Range of appropriate clearances not leading to delayed fracture | Remarks |
|---|---|---|---|---|---|---|---|---|
| 71 | 534 | 518 | 16 | 1620 | 10 | ◎ | X | COMP. EX. |
| 72 | 534 | 514 | 20 | 1609 | 10 | ◎ | ○ | INV. EX. |
| 73 | 526 | 512 | 14 | 1603 | 10 | ◎ | x | COMP. EX. |
| 74 | 454 | 442 | 12 | 1384 | 11 | ○ | ◎ | INV. EX. |
| 75 | 430 | 412 | 18 | 1290 | 15 | X | ◎ | COMP. EX. |
| 76 | 534 | 519 | 15 | 1624 | 10 | ◎ | ◎ | INV. EX. |
| 77 | The slab fractured during casting and the test was discontinued. | | | | | | | COMP. EX. |
| 78 | 527 | 511 | 16 | 1598 | 11 | ◎ | ○ | INV. EX. |
| 79 | 513 | 496 | 17 | 1551 | 11 | ◎ | x | COMP. EX. |
| 80 | 453 | 430 | 23 | 1345 | 11 | ◎ | ◎ | INV. EX. |
| 81 | 596 | 578 | 18 | 1809 | 9 | ◎ | ◎ | INV. EX. |
| 82 | The slab fractured during casting and the test was discontinued. | | | | | | | COMP. EX. |
| 83 | 444 | 422 | 22 | 1322 | 12 | ◎ | ◎ | INV. EX. |
| 84 | 598 | 580 | 18 | 1815 | 9 | ◎ | ◎ | INV. EX. |
| 85 | The slab fractured during casting and the test was discontinued. | | | | | | | COMP. EX. |
| 86 | 438 | 425 | 13 | 1329 | 14 | ◎ | ◎ | INV. EX. |
| 87 | 594 | 582 | 12 | 1822 | 9 | ◎ | ◎ | INV. EX. |
| 88 | The slab fractured during casting and the test was discontinued. | | | | | | | COMP. EX. |
| 89 | 510 | 490 | 20 | 1533 | 12 | ◎ | ○ | INV. EX. |
| 90 | 524 | 510 | 14 | 1596 | 11 | ◎ | ◎ | INV. EX. |
| 91 | The slab fractured during casting and the test was discontinued. | | | | | | | COMP. EX. |
| 92 | 527 | 507 | 20 | 1588 | 12 | ◎ | ◎ | INV. EX. |
| 93 | 532 | 515 | 17 | 1611 | 11 | ◎ | ◎ | INV. EX. |
| 94 | 525 | 510 | 15 | 1596 | 9 | ◎ | ◎ | INV. EX. |
| 95 | 521 | 502 | 19 | 1572 | 10 | ◎ | ◎ | INV. EX. |
| 96 | 532 | 519 | 13 | 1626 | 10 | ◎ | ◎ | INV. EX. |
| 97 | 518 | 504 | 14 | 1579 | 10 | ◎ | ◎ | INV. EX. |
| 98 | 535 | 517 | 18 | 1619 | 11 | ◎ | ◎ | INV. EX. |
| 99 | 524 | 506 | 18 | 1584 | 11 | ◎ | ◎ | INV. EX. |
| 100 | 534 | 513 | 21 | 1605 | 12 | ◎ | ◎ | INV. EX. |
| 101 | 532 | 518 | 14 | 1622 | 10 | ◎ | ◎ | INV. EX. |
| 102 | 535 | 519 | 16 | 1624 | 10 | ◎ | ◎ | INV. EX. |
| 103 | 538 | 523 | 15 | 1638 | 11 | ◎ | ◎ | INV. EX. |
| 104 | 541 | 528 | 13 | 1652 | 11 | ◎ | ◎ | INV. EX. |

Underlines indicate being outside of the range of the present invention.

The invention claimed is:

1. A high strength steel sheet comprising a microstructure having a chemical composition comprising, by mass %:

C: 0.15% or more and 0.45% or less,
Si: 0.50% or more and 2.00% or less,
Mn: 1.50% or more and 3.50% or less,
P: 0.100% or less,
S: 0.0200% or less,
Al: 0.010% or more and 1.000% or less,
N: 0.0100% or less, and
H: 0.0020% or less,
the balance being Fe and incidental impurities;
the microstructure being such that:
the area fraction of tempered martensite is 80% or more,
the volume fraction of retained austenite is 5% or more and 15% or less,
the area fraction of the total of ferrite and bainitic ferrite is 10% or less, and
the carbon concentration in retained austenite is 0.50% or more;
the microstructure satisfying formulas (1) and (2) defined below:

$$KAM\,(S)/KAM\,(C) < 1.00 \quad (1)$$

wherein KAM (S) is a KAM (Kernel average misorientation) value of a superficial portion of the steel sheet, and KAM (C) is a KAM value of a central portion of the steel sheet, $$Hv\,(Q) - Hv\,(S) \geq 8\,Hv \quad (2)$$

wherein Hv (Q) indicates the hardness of a portion at ¼ sheet thickness and Hv (S) indicates the hardness of the superficial portion of the steel sheet.

2. The high strength steel sheet according to claim 1, wherein the chemical composition further comprises one, or two or more elements selected from, by mass %:

Ti: 0.100% or less,
B: 0.0100% or less,
Nb: 0.100% or less,
Cu: 1.00% or less,
Cr: 1.00% or less,
V: 0.100% or less,
Mo: 0.500% or less,
Ni: 0.50% or less,
Sb: 0.200% or less,
Sn: 0.200% or less,
As: 0.100% or less,
Ta: 0.100% or less,
Ca: 0.0200% or less,
Mg: 0.0200% or less,
Zn: 0.020% or less,
Co: 0.020% or less,
Zr: 0.020% or less, and
REM: 0.0200% or less.

3. The high strength steel sheet according to claim 1, which has a coated layer on a surface of the steel sheet.

4. The high strength steel sheet according to claim 2, which has a coated layer on a surface of the steel sheet.

5. A method for manufacturing the high strength steel sheet described in claim 1, the method comprising:

providing a cold rolled steel sheet produced by subjecting a steel slab to hot rolling, pickling, and cold rolling;
annealing the steel sheet under conditions where:
a temperature T1 is 850° C. or above and 1000° C. or below and
a holding time t1 at T1 is 10 seconds or more and 1000 seconds or less;
cooling the steel sheet to a temperature T2 of 100° C. or above and 300° C. or below;
reheating the steel sheet under conditions where:
a temperature T3 is equal to or higher than T2 and 450° C. or below and
a holding time t3 at the temperature T3 is 1.0 second or more and 1000.0 seconds or less;
cooling the steel sheet to 100° C. or below;
starting working at an elapsed time t4 of 1000 seconds or less from the time when the temperature reaches 100° C.,
the working being performed under conditions where:
a working start temperature T4 is 80° C. or below and
an equivalent plastic strain is 0.10% or more and 5.00% or less;
tempering the steel sheet under conditions where:
a temperature T5 is 100° C. or above and 400° C. or below and
a holding time t5 at the temperature T5 is 1.0 second or more and 1000.0 seconds or less; and
cooling the steel sheet under conditions where a cooling rate θ1 from the temperature T5 to 80° C. is 100° C./sec or less.

6. A method for manufacturing the high strength steel sheet described in claim 2, the method comprising:

providing a cold rolled steel sheet produced by subjecting a steel slab to hot rolling, pickling, and cold rolling;
annealing the steel sheet under conditions where:
a temperature T1 is 850° C. or above and 1000° C. or below and
a holding time t1 at T1 is 10 seconds or more and 1000 seconds or less;
cooling the steel sheet to a temperature T2 of 100° C. or above and 300° C. or below;
reheating the steel sheet under conditions where:
a temperature T3 is equal to or higher than T2 and 450° C. or below and
a holding time t3 at the temperature T3 is 1.0 second or more and 1000.0 seconds or less;
cooling the steel sheet to 100° C. or below;
starting working at an elapsed time t4 of 1000 seconds or less from the time when the temperature reaches 100° C.,
the working being performed under conditions where:
a working start temperature T4 is 80° C. or below and
an equivalent plastic strain is 0.10% or more and 5.00% or less;
tempering the steel sheet under conditions where:
a temperature T5 is 100° C. or above and 400° C. or below and
a holding time t5 at the temperature T5 is 1.0 second or more and 1000.0 seconds or less; and
cooling the steel sheet under conditions where a cooling rate θ1 from the temperature T5 to 80° C. is 100° C./sec or less.

7. The method for manufacturing the high strength steel sheet according to claim 5, wherein the working before the tempering is performed under conditions where strain is applied by two or more separate working operations, and the total of the equivalent plastic strains applied in the working operations is 0.10% or more and 5.00% or less.

8. The method for manufacturing the high strength steel sheet according to claim 6, wherein the working before the tempering is performed under conditions where strain is applied by two or more separate working operations, and the total of the equivalent plastic strains applied in the working operations is 0.10% or more and 5.00% or less.

9. The method for manufacturing the high strength steel sheet according to claim 5, further comprising performing coating treatment between the annealing and the working.

10. The method for manufacturing the high strength steel sheet according to claim 6, further comprising performing coating treatment between the annealing and the working.

11. The method for manufacturing the high strength steel sheet according to claim 7, further comprising performing coating treatment between the annealing and the working.

12. The method for manufacturing the high strength steel sheet according to claim 8, further comprising performing coating treatment between the annealing and the working.

* * * * *